US012543779B2

(12) United States Patent
Whiffen et al.

(10) Patent No.: US 12,543,779 B2
(45) Date of Patent: Feb. 10, 2026

(54) SHAPING A TOBACCO INDUSTRY PRODUCT

(71) Applicant: British American Tobacco (Investments) Limited, London (GB)

(72) Inventors: Samuel Whiffen, London (GB); Thomas Brice, London (GB); John Richardson, London (GB); Karl Kaljura, London (GB); Gerhard Le Roux, Stellenbosch (ZA); Arnold Herholdt, Stellenbosch (ZA)

(73) Assignee: BRITISH AMERICAN TOBACCO (INVESTMENTS) LIMITED, London (GB)

( * ) Notice: Subject to any disclaimer, the term of this patent is extended or adjusted under 35 U.S.C. 154(b) by 1169 days.

(21) Appl. No.: 16/648,720

(22) PCT Filed: Sep. 28, 2018

(86) PCT No.: PCT/GB2018/052784
§ 371 (c)(1),
(2) Date: Mar. 19, 2020

(87) PCT Pub. No.: WO2019/064021
PCT Pub. Date: Apr. 4, 2019

(65) Prior Publication Data

US 2020/0214338 A1 Jul. 9, 2020

(30) Foreign Application Priority Data

Sep. 29, 2017 (GB) ..... 1715923.7

(51) Int. Cl.
*A24D 3/02* (2006.01)
*A24D 3/04* (2006.01)

(52) U.S. Cl.
CPC ..... *A24D 3/0279* (2013.01); *A24D 3/0262* (2013.01); *A24D 3/0291* (2013.01); *A24D 3/04* (2013.01)

(58) Field of Classification Search
CPC .. A24D 3/0262; A24D 3/0279; A24D 3/0291; A24D 3/04
See application file for complete search history.

(56) References Cited

U.S. PATENT DOCUMENTS 1,964,052 A * 6/1934 Halstead ..... A24C 1/32 131/93
3,205,899 A * 9/1965 Ackermann ..... A24C 3/00 131/287

(Continued)

FOREIGN PATENT DOCUMENTS

EP 0447130 A1 9/1991
EP 1637044 A1 3/2006

(Continued)

OTHER PUBLICATIONS

International Search Report for corresponding application PCT/GB2018/052784 filed Sep. 28, 2018; Mail date Dec. 11, 2018.

(Continued)

*Primary Examiner* — Philip Y Louie
*Assistant Examiner* — Yana B Krinker
(74) *Attorney, Agent, or Firm* — CANTOR COLBURN LLP

(57) ABSTRACT

There is described an apparatus for shaping a tobacco industry product, the apparatus comprising a shaping head configured to change the shape of a first end of the tobacco industry product. The apparatus also includes an actuator configured to move the shaping head and/or tobacco industry product such that the shaping head is brought into contact with the tobacco industry product in order to change the shape of the first end of the tobacco industry product. The (Continued)

actuator can be configured to move the shaping head and/or tobacco industry product in a direction substantially parallel to a longitudinal axis of the tobacco industry product. The shaping head can be brought into contact with a first longitudinal end surface and/or an inner surface of the tobacco industry product in order to change the shape of the tobacco industry product. Also described is a corresponding method of shaping a tobacco industry product and a tobacco industry product formed using the method.

8 Claims, 20 Drawing Sheets

(56) References Cited

U.S. PATENT DOCUMENTS 3,506,016 A * 4/1970 Smith ..... A24C 5/477 131/92
3,985,144 A * 10/1976 Payne ..... A24D 3/0258 131/92
4,157,370 A * 6/1979 Van Hall ..... A24D 3/0262 264/156

FOREIGN PATENT DOCUMENTS

| | | | |
|---|---|---|---|
| EP | 2653045 | A1 | 4/2012 |
| GB | 916042 | | 1/1963 |
| GB | 0108975 | A1 | 5/1984 |
| WO | 2011057969 | A1 | 5/2011 |
| WO | 2012156695 | A1 | 11/2012 |
| WO | 2015152072 | A1 | 3/2015 |

OTHER PUBLICATIONS

Written Opinion for corresponding application PCT/GB2018/052784 filed Sep. 28, 2018; Mail date Dec. 11, 2018.

* cited by examiner

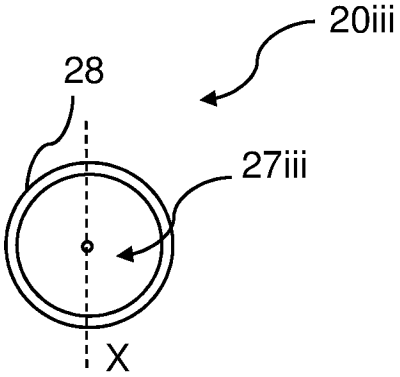
Figure 3e
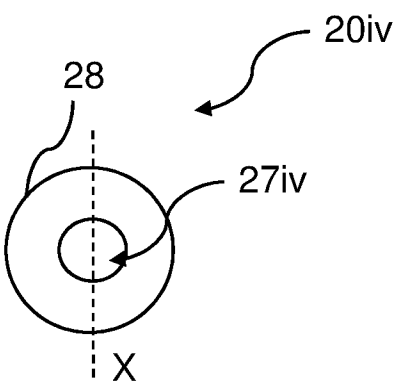
Figure 3f
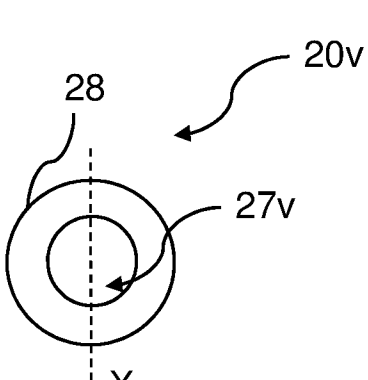
Figure 3g
Figure 3e'
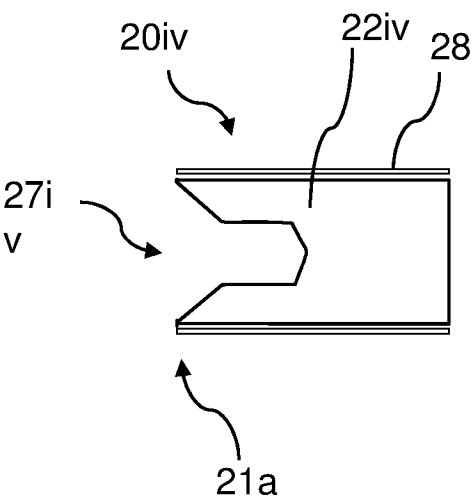
Figure 3f'
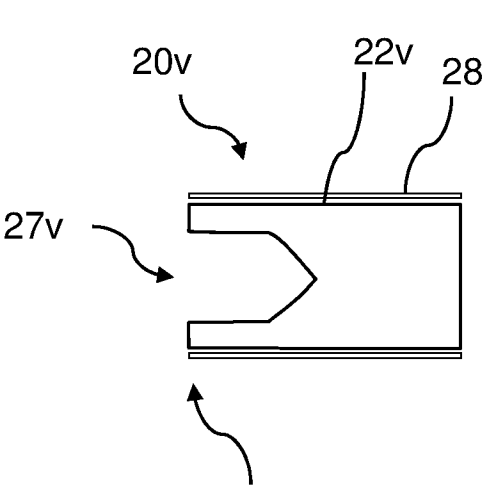
Figure 3g'

42ii

42i

42

42iii
42iv
42v
42vi

42vii
42viii
42ix
42x
42xi

42xii
42xiii
42xiv

SHAPING A TOBACCO INDUSTRY PRODUCT

TECHNICAL FIELD

The present invention relates to an apparatus and method for shaping a tobacco industry product and to a tobacco industry product formed by the method.

BACKGROUND

Cigarettes and other smoking articles produce an aerosol, such as smoke in the case of cigarettes, which is inhaled by a user. A filter may be provided as part of a smoking article, or can be provided as a separate component which can be attached or coupled to a smoking article by a user. Filters can be configured to modify properties of aerosol produced by the smoking article; for example, by adding flavourant to the aerosol produced by the smoking article.

SUMMARY

According to embodiments of the invention, there is provided an apparatus for shaping a tobacco industry product, the apparatus comprising a shaping head configured to change the shape of a first end of the tobacco industry product and an actuator configured to move the shaping head and/or tobacco industry product in a direction substantially parallel to a longitudinal axis of the tobacco industry product such that the shaping head is brought into contact with the first end of the tobacco industry product in order to change the shape of the first end.

According to embodiments of the invention, there is provided an apparatus for shaping a tobacco industry product, the apparatus comprising a shaping head configured to change the shape of a first end of the tobacco industry product and an actuator configured to move the shaping head and/or tobacco industry product such that the shaping head is brought into contact with a first longitudinal end surface and/or an inner surface of the tobacco industry product in order to change the shape of the first end.

The actuator can be configured to move the shaping head and/or tobacco industry product in a reciprocating manner.

The shaping head can have a chamfered profile.

The shaping head can be substantially conical, cylindrical or hemispherical in shape.

The shaping head can have a portion which has a chamfered profile and a portion which is substantially conical, cylindrical or hemispherical in shape.

The shaping head can have order 1, 2, 3, 4, 5, 6, 7, 8, or infinite rotational symmetry.

The shaping head can have a longitudinal axis and the apparatus can be configured to rotate the shaping head about the longitudinal axis of the shaping head.

The apparatus can be configured such that, in use, the longitudinal axis of the shaping head is aligned with the longitudinal axis of the tobacco industry product.

The shaping head can comprise one of a plurality of shaping heads, each shaping head arranged to be brought into contact with a respective first end of a tobacco industry product in order to change the shape of the first end, and a head support unit can be arranged to support the plurality of shaping heads.

The plurality of shaping heads and head support unit can be provided on a drum. The drum can comprise a first drum comprising a first plurality of shaping heads and a first head support unit and the apparatus can comprise a second drum comprising a second plurality of shaping heads and a second head support unit arranged to support the second plurality of shaping heads. The first and second drums can be arranged to operate in series or in parallel in a machine.

The drum can comprise a plurality of receiving units each arranged to grip a tobacco industry product.

The apparatus can comprise a pushing member arranged to push a second end of the or each tobacco industry product while the or each shaping head is brought into contact with the or each tobacco industry product. The pushing member can be formed from a resiliently deformable material.

The apparatus can comprise a heating element arranged to heat the shaping head.

The shaping head can be formed from a material which can be heated by induction and the heating element can be arranged to heat the shaping head by induction.

The apparatus can comprise a wrapping unit arranged to wrap a sleeve at least partially around the tobacco industry product.

The apparatus can comprise a cutting unit arranged to divide the tobacco industry product into two tobacco industry products.

According to embodiments of the invention, there is provided a method of shaping a tobacco industry product, the method comprising providing the tobacco industry product and changing a shape of a first end of the tobacco industry product by moving a shaping head and/or the tobacco industry product in a direction substantially parallel to a longitudinal axis of the tobacco industry product such that the shaping head is brought into contact with the first end of the tobacco industry product.

According to embodiments of the invention, there is provided a method of shaping a tobacco industry product, the method comprising providing the tobacco industry product and changing a shape of a first end of the tobacco industry product by moving a shaping head and/or the tobacco industry product such that the shaping head is brought into contact with a first longitudinal end surface and/or an inner surface of the tobacco industry product.

The method can comprise rotating the shaping head about a longitudinal axis of the shaping head.

Moving the shaping head and/or the tobacco industry product can comprise moving the shaping head and/or tobacco industry product in a reciprocating manner.

The providing of the tobacco industry product can comprise inserting the tobacco industry product into a receiving unit.

The method can comprise gripping the tobacco industry product in the receiving unit.

The method can comprise changing a shape of a first end of each of a plurality of tobacco industry product simultaneously using a plurality of shaping heads. The shaping heads can be provided on first and second drums arranged in a series or in a parallel configuration.

The method can comprise wrapping a sleeve at least partially around the tobacco industry product.

The method can comprise heating the or each shaping head.

The method can comprise dividing the or each tobacco industry product into two tobacco industry products.

According to embodiments of the invention, there is provided a tobacco industry product formed using the method set out above.

BRIEF DESCRIPTION OF THE DRAWINGS

Embodiments of the invention will now be described, by way of example only, with reference to the accompanying drawings, in which:

FIG. 3*e* is an end-on view of another third filter unit design, this design having a substantially cone shaped recess;

FIG. 3*e*' is a side-on cross sectional view of the third filter unit design of FIG. 3*e;*

FIG. 3*f* is an end-on view of another third filter unit design, this design having a recess having a first portion in the form of a frustum cone, a second portion in the form of a cylinder and a third portion in the form of a cone;

FIG. 3*f* is a side-on cross sectional view of the third filter unit design of FIG. 3*f;*

FIG. 3*g* is an end-on view of another third filter unit design, this design having a recess having a first portion in the form of a cylinder and a second portion in the form of a cone;

FIG. 3*g*' is a side-on cross sectional view of the third filter unit design of FIG. 3*g;*

FIG. 3*h*' is a side-on cross sectional view of the third filter unit design of FIG. 3*h;*

FIG. 3*i*' is a side-on cross sectional view of the third filter unit design of FIG. 3*i;*

FIG. 3*j*' is a side-on cross sectional view of the third filter unit design of FIG. 3*j;*

FIGS. 6*a*' to 6*o*' are end-on views of the respective first to fifteenth shaping heads of FIGS. 6*a* to 6*o;*

DETAILED DESCRIPTION

Figure 1A:
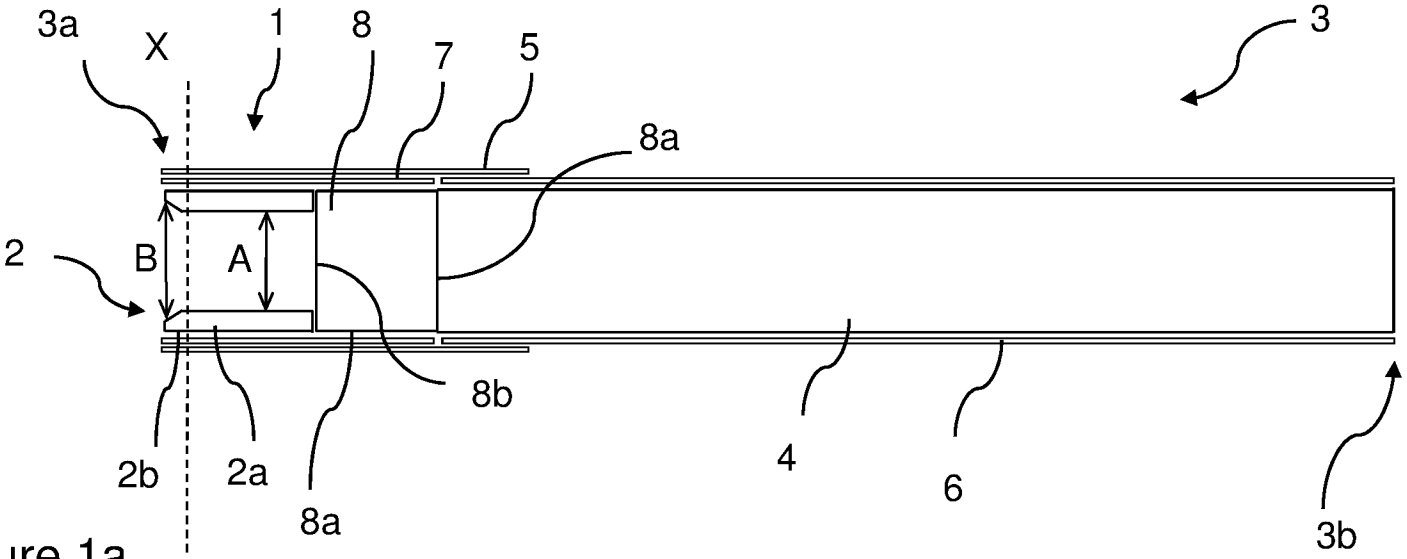
FIG. 1*a* is a side-on cross sectional view of a first filter unit including a tube formed from filter material and where the filter unit forms part of a smoking article.

As used herein, the term "tobacco industry product" is intended to include smoking articles comprising combustible smoking articles and their components such as cigarettes, cigarillos, cigars, tobacco for pipes or for roll-your-own cigarettes, (whether based on tobacco, tobacco derivatives, expanded tobacco, reconstituted tobacco, tobacco substitutes or other smokable material), electronic smoking articles and their components such as e-cigarettes, heating devices that release compounds from substrate materials without burning such as tobacco heating products, and hybrid systems to generate aerosol from a combination of substrate materials, for example hybrid systems containing a liquid or gel or solid substrate; and aerosol-free nicotine delivery articles and their components such as lozenges, gums, patches, articles comprising breathable powders and smokeless tobacco products such as snus and snuff. Components of the above articles include filter units, filter plugs, filter inserts and tubes for use in products such as smoking articles;

In one embodiment, the tobacco industry product is a smoking article for combustion, selected from the group consisting of a cigarette, a cigarillo and a cigar.

In one embodiment, the tobacco industry product is a non-combustible smoking article.

In one embodiment, the tobacco industry product is a heating device which releases compounds by heating, but not burning, a substrate material. The material may be for example tobacco or other non-tobacco products, which may or may not contain nicotine. In one embodiment, the heating device is a tobacco heating device.

In one embodiment, the tobacco industry product is a hybrid system to generate aerosol by heating, but not burning, a combination of substrate materials. The substrate materials may comprise for example solid, liquid or gel which may or may not contain nicotine. In one embodiment, the hybrid system comprises a liquid or gel substrate and a solid substrate. The solid substrate may be for example tobacco or other non-tobacco products, which may or may not contain nicotine. In one embodiment, the hybrid system comprises a liquid or gel substrate and tobacco. Filter units described herein can be provided to users as an integral component of a smoking article or as a discrete component separate from a smoking article. When provided separately, filter units and smoking articles can be packaged separately, or packaged together as a kit of parts.

Smoking articles such as cigarettes and their formats are often named according to the cigarette length: "regular" (typically in the range 68-75 mm, e.g. from about 68 mm to about 72 mm), "short" or "mini" (68 mm or less), "king-size" (typically in the range 75-91 mm, e.g. from about 79 mm to about 88 mm), "long" or "super-king" (typically in the range 91-105 mm, e.g. from about 94 mm to about 101 mm) and "ultra-long" (typically in the range from about 110 mm to about 121 mm).

They are also named according to the cigarette circumference: "regular" (about 23-25 mm), "wide" (greater than 25 mm), "slim" (about 22-23 mm), "demi-slim" (about 19-22 mm), "super-slim" (about 16-19 mm), and "micro-slim" (less than about 16 mm). Accordingly, a cigarette in a king-size, super-slim format will, for example, have a length of about 83 mm and a circumference of about 17 mm. Cigarettes in the regular, king-size format are preferred by many customers, namely with a circumference of from 23 to 25 mm and an overall length of from 75 to 91 mm.

Each format may be produced with filters of different lengths, smaller filters being generally used in formats of smaller lengths and circumferences. Typically the filter length will be from about 15 mm, associated with short, regular formats, to 30 mm, associated with ultra-long super-slim formats. The tipping paper will have a greater length than the filter, for example from 3 to 10 mm longer, such that the tipping paper covers the filter and overlaps the tobacco rod to connect the filter to the tobacco rod.

Smoking articles and filter units described herein can be made in, but are not limited to, any of the above formats.

The filter material forming any of the filter units or other filter components described herein can comprise cellulose acetate fibre tow. The filter material can also be formed using other materials used to form fibres, such as polyvinyl alcohol (PVOH), polylactic acid (PLA), polycaprolactone (PCL), poly(1-4 butanediol succinate) (PBS), poly(butylene adipate-co-terephthalate)(PBAT), starch based materials, paper, cotton, aliphatic polyester materials and polysaccharide polymers or a combination thereof. The filter material may be plasticised with a suitable plasticiser for the filter material, such as triacetin where the filter material is cellulose acetate tow, or may be non-plasticised. The tow used to produce the filter unit or other filter component can use any suitable specification, such as fibres having a 'Y' shaped or other cross section, filamentary denier values between 2.5 and 15 denier per filament, for example between 3.0 and 9.0 denier per filament and total denier values of 10,000 to 50,000, for example between 15,000 and 45,000.

As used herein, the terms "flavour" and "flavourant" refer to materials which, where local regulations permit, may be used to create a desired taste or aroma in a product for adult consumers. They may include extracts (e.g., liquorice, hydrangea, Japanese white bark magnolia leaf, chamomile, fenugreek, clove, menthol, Japanese mint, aniseed, cinnamon, herb, wintergreen, cherry, berry, peach, apple, Drambuie, bourbon, scotch, whiskey, spearmint, peppermint, lavender, cardamom, celery, cascarilla, nutmeg, sandalwood, bergamot, geranium, honey essence, rose oil, vanilla, lemon oil, orange oil, cassia, caraway, cognac, jasmine, ylang-ylang, sage, fennel, piment, ginger, anise, coriander, coffee, or a mint oil from any species of the genus *Mentha*), flavour enhancers, bitterness receptor site blockers, sensorial receptor site activators or stimulators, sugars and/or sugar substitutes (e.g., sucralose, acesulfame potassium, aspartame, saccharine, cyclamates, lactose, sucrose, glucose, fructose, sorbitol, or mannitol), and other substances or additives such as charcoal, chlorophyll, minerals, botanicals, or breath freshening agents. They may be imitation, synthetic or natural ingredients or blends thereof. They may be in any suitable form, for example, oil, liquid, or powder.

In the figures described herein, like reference numerals are used to illustrate equivalent features, articles or components.

FIG. 1*a* is a side-on cross sectional view of a first filter unit 1 including a tube 2, formed from filter material in the present example, and forming part of a smoking article 3. The smoking article 3 has a mouth end 3*a*, arranged to be placed in the user's mouth when smoking, and a lit end 3*b*, arranged to be lit when smoking. The filter unit 1 is connected to an aerosol generating material 4, in the present case cut tobacco in the form of a rod, by a tipping paper 5. The aerosol generating material 4 is wrapped in a wrapper 6, for instance cigarette paper.

The tube 2 comprises a wall having inner and outer surfaces which are substantially circular in cross section, in the present example, for cross sections taken along the longitudinal length of the tube. An inner diameter of the tube 2 is defined between two diametrically opposite points on the inner surface of the wall of the tube, while an outer diameter of the tube 2 is defined between two diametrically opposite points on the outer surface of the wall of the tube. The wall of the tube 2 may have a thickness in the range of about 0.5 mm to about 5 mm. For example, the wall may have a thickness of between about 1 mm and about 4 mm, between about 1.0 mm and about 3 mm or between about 1.0 mm and about 2 mm, or between about 1.5 mm and 2.5 mm, or about 1.3 mm. In a particular embodiment, the wall may have a thickness of about 2.2 mm, having an inner diameter of about 3.0 mm and an outer circumference of about 23.4 mm. Where the wall thickness varies along the length of the tube 2, the thickness values set out above can be taken as the maximum thickness of the wall.

The tube 2 has a first portion 2*a* and a second portion 2*b*. In FIG. 1, these portions 2*a*, 2*b* are disposed longitudinally along the length of the tube 2. As shown in FIG. 1, the first and second portions 2*a*, 2*b* are arranged either side of a longitudinal position on the tube indicated by dashed line 'X'. The first portion 2*a* of the tube 2 extends from an end of the tube 2 furthest from the mouth end 3*a* of the smoking article 3 up to the dashed line 'X', and the second portion 2*b* of the tube 2 extends from the dashed line 'X' to the mouth end 3*a* of the smoking article. An inner diameter of the first portion 2*a* of the tube 2 is different from an inner diameter of the second portion 2*b* of the tube 2. The second portion 2*b* is at a distal end of the filter unit, in particular at the mouth end 3*a* of the smoking article 3 in the present example.

In the present example, an inner diameter of the second portion 2*b*, illustrated in FIG. 1*a* by arrow 'B', is greater than an inner diameter of the first portion 2*a*, illustrated by arrow 'A'. The inner diameter 'A' of the first portion 2*a* can be in the range of about 2 mm to about 6 mm, about 3 mm to about 5 mm, or about 3 mm to about 4 mm. For example, the inner diameter of the first portion 2*a* may be about 3 mm, about 4 mm or about 5 mm. The inner diameter 'B' of the second portion 2*b* varies along the length of the second portion 2*b* in the present example. The largest inner diameter 'B' of the second portion 2*b* can be in the range of about 2.5 mm to about 8 mm, about 3 mm to about 7 mm, or about 4 mm to about 6 mm. For example, the largest inner diameter 'B' of the second portion 2*b* may be about 5 mm. In a particular embodiment, the wall may have a thickness of about 2.2 mm in the first portion 2*a* and an inner diameter 'A' of the first portion of about 3 mm, and a largest internal diameter 'B' of the second portion 2*b* may be about 5.45 mm, while the tube 2 has an outer circumference of about 23.4 mm. In alternative examples, the circumference of the tube 2 can vary between about 20 mm and about 25 mm, for instance between about 22 mm and about 25 mm. The circumference of the tube 2 can be, for instance, about 24.8 mm, about 23.4 mm or greater than about 22 mm.

The overall length of the tube 2 may be in the range of about 3 mm to about 25 mm, or about 5 mm to about 12 mm. For example, the length of the tube 2 may be about 5, 6, 7, 8, 9 or 10 mm.

The length of the first portion 2*a* may be in the range of about 2 mm to about 25 mm, or about 4 mm to about 10 mm. For example, the length of the first portion 2*a* may be about 4, 5, 6, 7, 8 or 9 mm.

The length of the second portion 2*b* may be in the range of about 0.5 mm to 8 mm. For example, the length of the second portion 2*b* may be about 1 mm to about 5 mm, about 1 mm to about 3 mm, about 2 mm or about 1.2 mm.

The non-uniformity in inner diameter of the second portion 2*b* may be formed by indenting the filter material at the end of the tube 2 closest to the mouth end 3*a* of the smoking article. The tube 2 of filter material can have a first end surface at the end of the tube 2 at the mouth end 3*a* of the smoking article 3 and a second end surface at its longitudinal end opposite to the first end surface. In the present example, the first and second end surfaces are perpendicular to the longitudinal axis, although they could alternatively be at an angle other than 90° to the longitudinal axis. The tube 2 of filter material is formed from a plurality of continuous fibres extending between said first and second end surfaces. For instance, the filter material can be cellulose acetate tow with a denier per filament of between 3 dpf and 8 dpf and a total denier of between 15,000 and 40,000 denier. In one example, the filter material comprises a cellulose acetate tow with a denier per filament of 5 dpf and a total denier of 30,000 denier. In another example, the filter material comprises a cellulose acetate tow with a denier per filament of 7 dpf and a total denier of 36,000 or 33,000 denier. The filter material can comprise between 12% and 25% plasticiser by weight. For instance, filter material can comprise between about 15% and 21% plasiciser or from about 17% to 18% plasticiser by weight. The density of the filter material is greater at the first end surface than at said second end surface. This is, for instance, due to the indentation or other compression of the filter material to form the second portion 2*b* having reduced diameter.

The 'in-product' filter hardness of the filter units described herein refers to the filter rigidity when measured 3 mm from the mouth end of the filter unit in the final product, using a Borgwaldt H10 measurement device or similar apparatus. In-product hardness is defined as the ratio between the height $h_0$ of a filter segment and the remaining height $h_1$ having a defined load applied. It is stated as a percentage of the $h_0$ (and therefore has no physical unit of measure).

$$\textit{In}\text{-product hardness}=(h_1/h_0)\times 100$$

Where, $h_0$=initial height $h_1$=remaining height (under load)

Samples are conditioned at 22° C./60% r.H. for a minimum of 48 hours. A total of 20 specimens are tested.

Instrument parameters are set to the following:

Lowering Speed: 0.6 mm/s

Load Weight: 150 g

Load Time: 5 s

Contact Time: 1 s

Contact Weight: 2 g

Lower load bar: plain

Upper load bar: R 3 mm

Upon use of the Borgwaldt H10 measurement device, the samples are placed in the hopper and testing is performed automatically such that each individual sample is measured for both $h_0$ and $h_1$ at a first measurement position under the load bar. The sample is then moved to the next measurement position and the heights will be measured again. The process repeats until all samples provided are measured at all measurement positions.

The hardness of the tubes described herein, as measured according to the above process and with the tube forming the mouth-end filter component of a cigarette, can be between about 85% and 95%, in particular between about 88% and 94% and in one example about 89%. The process of indenting the filter material to form the non-uniformity in inner diameter of the second portion 2*b* can increase the hardness of the tube by between about 2% and about 10%, between about 2% and about 6% or about 5% or about 6%. In one example of a tube having an inner diameter of 3 mm, an outer circumference of 23.4 mm, a tow specification of 50.0Y30,000 and a base rod hardness of 92% before application to a cigarette, the hardness has been measured as 84.7% when applied to a cigarette and 89.4% when a 45°, 1.2 mm depth chamfer is applied to the inner mouth-end edge of the tube. The tube segment is 7 mm in length, and has a segment weight (unwrapped) of 49 mg and 17% triacetin plasticiser. The tube is combined with first and second upstream filter segments (for instance a first segment comprising filter material and a 3.0 mm capsule as described herein embedded within a central portion of the filter material, and a second segment, upstream of the first segment, comprising particles of activated carbon dispersed within filter material). The overall filter length can be between about 15 mm and about 30 mm, for instance about 27 mm.

In another example of a tube having an inner diameter of 3 mm, an outer circumference of 23.4 mm, a tow specification of 7.0Y33,000 and a base rod hardness of 94% before application to a cigarette, the hardness has been measured as 87.9% when applied to a cigarette and 91.6% when a 45°, 1.2 mm depth chamfer is applied to the inner mouth-end edge of the tube. The tube segment is 7 mm in length, and has a segment weight (unwrapped) of 54 mg and 17% triacetin plasticiser. The tube is combined with first and second upstream filter segments as described above.

In another example of a tube having an inner diameter of 3 mm, an outer circumference of 23.4 mm, a tow specification of 7.0Y36,000 and a base rod hardness of 96% before application to a cigarette, the hardness has been measured as 91.2% when applied to a cigarette and 93.3% when a 45°, 1.2 mm depth chamfer is applied to the inner mouth-end edge of the tube. The tube segment is 7 mm in length, and has a segment weight (unwrapped) of 60 mg and 18% triacetin plasticiser. The tube is combined with first and second upstream filter segments as described above.

The tube tow weight can be in the range of 600 to 800 mg, for instance 700 mg to 730 mg for an 84 mm base rod length.

Table 1 below provides the hardness level for tubes before and after chamfering based on a 45°, 1.2 mm depth chamfer applied to the inner mouth-end edge of the tube. 50 samples for each of three starting tube designs were tested.

TABLE 1

| | Unchamfered Tube (hardness %) | | | Chamfered Tube (hardness %) | | |
|---|---|---|---|---|---|---|
| Mean | 84.7 | 87.9 | 91.2 | 89.4 | 91.6 | 93.3 |
| SD | 0.9 | 0.8 | 0.7 | 0.9 | 0.7 | 0.6 |

TABLE 1-continued

| | Unchamfered Tube (hardness %) | | | Chamfered Tube (hardness %) | | |
|---|---|---|---|---|---|---|
| CofV | 1.10 | 0.92 | 0.79 | 1.05 | 0.77 | 0.61 |
| Max | 87.1 | 89.4 | 92.6 | 91.8 | 92.9 | 95.0 |
| Min | 82.6 | 85.7 | 89.8 | 87.1 | 90.1 | 91.8 |
| Range | 4.5 | 3.7 | 2.8 | 4.7 | 2.8 | 3.2 |

Alternatively, the non-uniformity in inner diameter of the second portion 2*b* may be formed by cutting the end of the tube 2 to remove filter material from the end of the tube 2. This can give rise to a reduction rather than an increase in tube hardness.

In the present example, as illustrated in FIG. 1*a*, the outer diameter of the second portion 2*b* is the same as the outer diameter of the first portion 2*a*.

In the present example, each of the first portion 2*a* and the second portion 2*b* has a first end and a second end. The second end of the first portion 2*a* adjoins the first end of the second portion 2*b*, and has an inner diameter substantially the same as the first end of the second portion 2*b*.

The tube 2 has a longitudinal axis (not shown). The inner surface of the first portion 2*a* is substantially parallel to the longitudinal axis of the tube 2. The inner surface of the second portion 2*b* is chamfered in that it is at an angle to the longitudinal axis of the tube 2, in the present example. The inner diameter of the second portion 2*b* decreases with distance from a distal end, for instance the mouth end 3*a*, of the filter unit. The angle of intersection between a straight line following the inner surface of the second portion 2*b* of the tube 2 and the longitudinal axis of the tube 2 may be any angle other than 90°, for instance an angle in the range of about 10° to about 80°, or about 20° to about 70°, or about 30° to about 60°. For example, the angle may be about 45°.

Figure 1E:
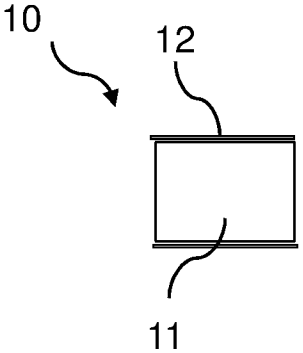
FIG. 1*e* is a side-on cross sectional view of a filter insert for use with the first filter unit of FIG. 1*a;*
Figure 1D:
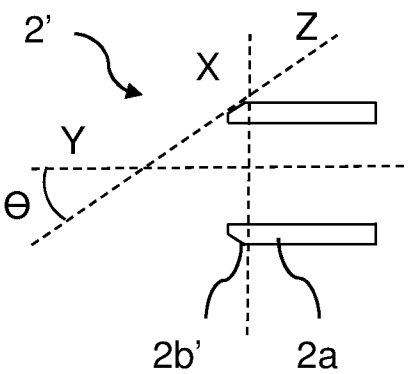
FIG. 1*d* is a further side-on cross sectional view of the outer chamfered tube of FIG. 1*b;*
Figure 1C:
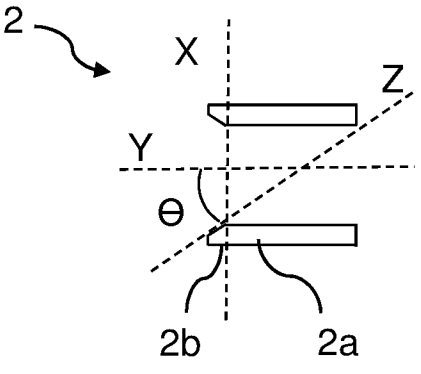
FIG. 1*c* is a further side-on cross sectional view of the tube formed from filter material of FIG. 1*a;*

FIG. 1*c* is a further side-on cross sectional view of the tube 2 formed from filter material of FIG. 1*a*, illustrating the angle of intersection 'e' between a straight line 'Z' following the inner surface of the second portion 2*b* of the tube 2 and the longitudinal axis 'Y' of the tube 2. The angle of intersection 'e' may be any angle other than 90°, for instance an angle in the range of about 10° to about 80°, or about 20° to about 70°, or about 30° to about 60°. For example, the angle may be about 45°.

Although a tube 2 having a uniformly chamfered inner edge has been described with reference to FIGS. 1*a* and 1*c*, other tube shapes can be used. For instance, the second portion 2*b* of the tube 2 can have an inner diameter 'B' which is uniform along the length of the second portion 2*b*, and therefore forms a step at the location shown by line 'X' between the first and second portions 2*a*, 2*b*. Alternatively or in addition, a chamfer or step as described in respect of the inner diameter of the second portion 2*b* of the tube 2 may be provided in the outer diameter of the second portion 2*b* of the tube 2.

Figure 1B:
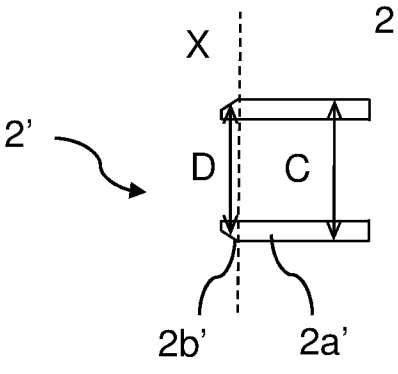
FIG. 1*b* is a side-on cross sectional view of an outer chamfered tube for use as an alternative to the tube used in the first filter unit of FIG. 1*a;*

FIG. 1*b* illustrates an outer chamfered tube 2' which can be used in place of the tube 2 used in the smoking article 3 of FIG. 1*a*, in which a chamfer is provided on an outer edge of the tube 2' such that an outer diameter of the second portion 2*b*', illustrated in FIG. 1*b* by arrow 'D', is smaller than an outer diameter of the first portion 2*a*', illustrated by arrow 'C'. FIG. 1*d* is a further side-on cross sectional view of the outer chamfered tube of FIG. 1*b*. As shown in FIG. 1*d*, the tube 2' has a longitudinal axis 'Y'. The outer surface of the first portion 2*a*' is substantially parallel to the longitudinal axis 'Y' of the tube 2'. The outer surface of the second portion 2*b*' is chamfered in that it is at an angle to the longitudinal axis of the tube 2', in the present example. The angle of intersection 'e' between a straight line 'Z' following the outer surface of the second portion 2*b*' of the tube 2' and the longitudinal axis 'Y' of the tube 2' may be any angle other than 90°, for instance an angle in the range of about 10° to about 80°, or about 20° to about 70°, or about 30° to about 60°. For example, the angle may be about 45°.

In summary, tubes 2, 2' are formed from filter material and have a longitudinal axis 'Y', wherein a straight line 'Z' following at least a portion of an internal or external surface of the tube 2, 2' would intersect the longitudinal axis 'Y' at an angle other than 90°. The internal or external surface of the tube 2, 2' is adjacent to a longitudinal end surface of the tube 2, 2'.

The straight line 'Z' can be taken as a first straight line following a first portion of the internal or external surface of the tube and a second straight line following a second portion of the internal or external surface of the tube can be parallel to the longitudinal axis 'Y'. For instance, the internal and external surfaces of the first portion 2*a*, 2*a*' of the tubes 2, 2' of FIGS. 1*a* and 1*b* extend at a fixed distance from said longitudinal axis and therefore straight lines following such surfaces would be parallel to the longitudinal axis.

The angle other than 90° can be between about 20° and about 70°, and/or between about 30° and about 60° and/or between about 35° and about 55° and/or is about 45°.

Referring again to FIG. 1*a*, in the present example, the first filter unit 1 further includes a sleeve 7. The sleeve 7 is formed from a sheet material such as plug wrap. In alternative examples, the sleeve 7 can be formed in other ways, for instance from plastic or other materials.

The first filter unit 1 also includes an upstream filter segment 8, arranged upstream of the tube 2 in the direction of mainstream smoke when the smoking article is drawn on by a user. The upstream filter segment 8 has a longitudinal axis (not shown). The upstream filter segment 8 has a curved outer surface 8*a* circumscribing the segment 8, a first longitudinal end surface 8*a* closest to the lit end 3*a* of the smoking article 3 and a second longitudinal end surface 8*b* closest to the mouth end 3*a* of the smoking article 3. The longitudinal end surfaces 8*a*, 8*b* are perpendicular to the longitudinal axis of the upstream filter segment 8. In the present example, the tube 2 and the upstream filter segment 8 have a common longitudinal axis.

The sleeve 7 is wrapped around the tube 2 and the upstream filter segment 8. In the present example, an adhesive is provided between the sleeve 7 and the tube 2 and upstream filter segment 8 and in this way the sleeve 7 connects the tube 2 to the upstream filter segment 8.

In the present example, the end of the tube 2 closest to the mouth end 3*a* of the smoking article 3 is flush with the end of the sleeve 7 closest to the mouth end 3*a* of the smoking article 3. However, in alternative examples, the tube 2 may extend beyond the end of the sleeve 7 closest to the mouth end 3*a* of the smoking article 3, or may stop short of the end of the sleeve 7 closest to the mouth end 3*a* of the smoking article 3. For instance, when the outer chamfered tube 2' of FIG. 1*b* is used in place of the tube 2 of FIG. 1*a*, the sleeve 7 may surround only the first portion 2*a*' of the tube 2', and the tipping 5 can also extend up to the edge of the sleeve 7 closest to the mouth end 3*a* of the smoking article 3. In this way, the smoking article 3 can be provided with an outer chamfered edge at the mouth end 3*a* giving a smooth surface against which the users lips can be placed, facilitating the user in holding the smoking article in their mouth. In the present example, the sleeve 7 fully surrounds the outer surface of the upstream filter segment 8.

The length of the upstream filter segment 8 may be selected according to the desired filtration performance of the filter unit 1, and may be in the range 5 mm to 25 mm, or 10 mm to 15 mm. For example, the length of the upstream filter segment 8 may be about 12 mm.

The outer diameter of the upstream filter segment 8 may be substantially the same as the outer diameter of the tube 2. Either or both of the tube 2 and the upstream filter segment may comprise a separate plug wrap (not shown) around which the sleeve 7 is wrapped.

The tube 2 and upstream filter segment 8 may be formed of filter material, in particular a fibrous filter material. The tube 2 and/or upstream filter segment 8 can contain substances such as additives or agents for modifying the aerosol, in the present case smoke, generated by the smoking article 3. For example, a frangible capsule (not shown) containing a flavourant or other additive such as water may be located within the upstream filter segment 8. The capsule can be located at a central longitudinal position within the upstream filter segment 8, or may be offset from the central longitudinal position.

The capsule has a liquid centre and a frangible outer shell which can be broken by a user by squeezing the filter unit 1, to thereby release the flavourant. The flavourant is transferred to the aerosol generated by the smoking article 3 as the smoking article 3 is smoked by the user.

In alternative examples, the first filter unit 1 may include alternative substances such as additives or agents for modifying the aerosol generated by the smoking article 3, such as granules of activated carbon or other adsorbents, humectants, diluents etc.

The smoking article 3 can be a cigarette in any of the smoking article formats described herein.

FIG. 1*e* is a side-on cross sectional view of a filter insert 10 for use with the filter unit of FIG. 1*a*. The filter insert 10 includes a cylindrical element 11 formed from cellulose acetate tow wrapped in a sleeve 12, in the present case a plug wrap. The filter insert 10 may be inserted into the hollow centre of the tube 2 of the smoking article 3 by a user, for instance such that the insert 10 abuts the second longitudinal end surface 8*b* of the upstream filter segment 8. The filter insert 10 may include a smoke modifying substance or additive allowing the user to alter properties of the aerosol passing through the smoking article 3 when the smoking article 3 is smoked and the filter insert 10 is inserted into the tube 2. The inner chamfer in the second portion 2*b* of the tube 2 can facilitate insertion of the filter insert 10 into the tube 2 and, for instance, enable the outer diameter of the filter insert 10 to be substantially the same as the inner diameter 'A' of the tube 2, which would otherwise make insertion of the insert 10 into the tube difficult.

Figure 2:
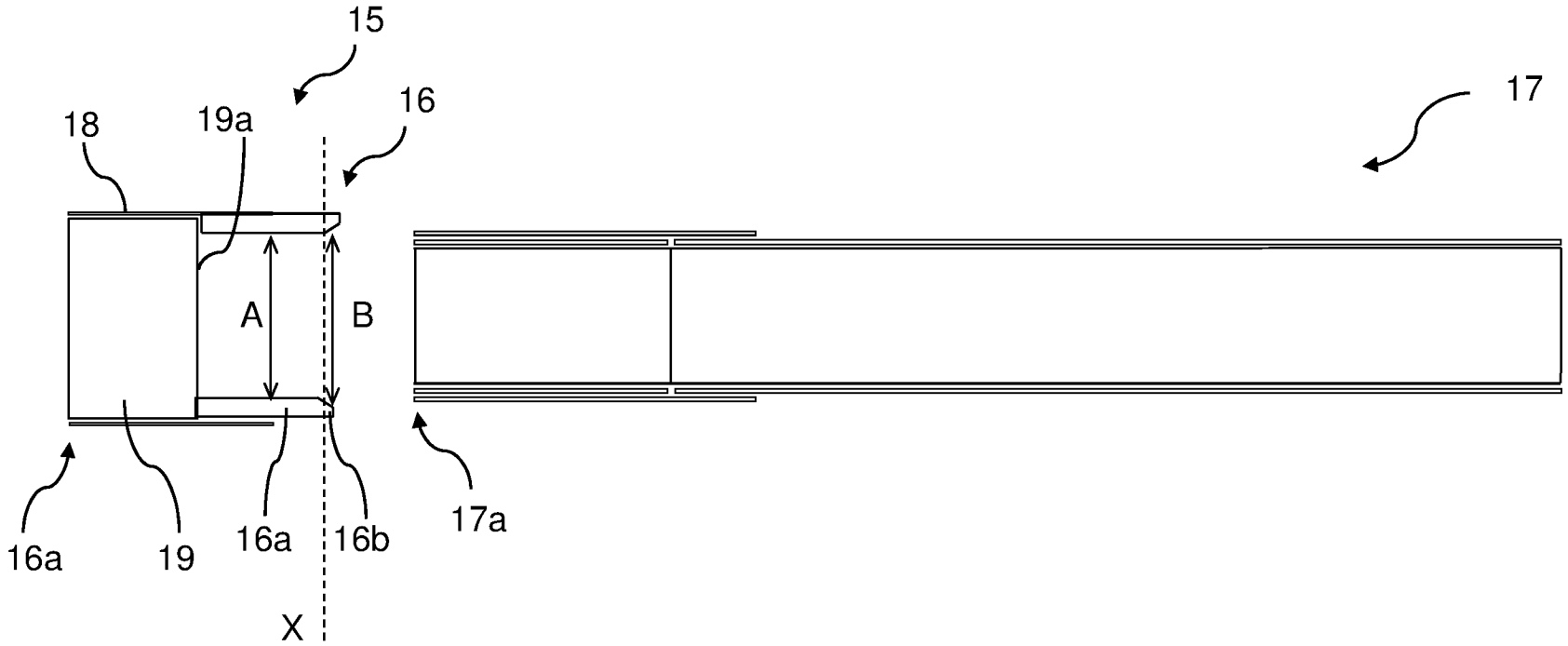
FIG. 2 is a side-on cross sectional view of a second filter unit including a tube formed from filter material and where the filter unit is provided as a discrete unit for use with a separate smoking article.

FIG. 2 is a side-on cross sectional view of a discrete second filter unit 15 including a tube 16 formed from filter material and provided as a separate unit 15 for use with a smoking article 17. The second filter unit 15 can be attached onto the mouth end 17*a* of the smoking article 17 by a user. The second filter unit 15 is configured to modify one or more properties of an aerosol, such as smoke, which is generated by the smoking article 17. The second filter unit 15 has a mouth end 16*a* arranged to be inserted into a user's mouth when the second filter unit 15 is attached to the smoking article 17.

The tube 16 of the second filter unit 15 is generally similar in design to the tube 2 of the first filter unit 1 illustrated in FIG. 1*a*, and corresponding features and dimensions apply except where alternatively stated below.

The tube 16 has a first portion 16*a* and a second portion 15*b*. These portions 16*a*, 10 are the portions of the tube 16 either side of a longitudinal position on the tube indicated in FIG. 2 by dashed line 'X'. The first portion 16*a* of the tube 16 extends from an end of the tube 16 closest to the mouth end 16*a* of the second filter unit 15 up to the dashed line 'X', and the second portion 16*b* of the tube 16 extends from the dashed line 'X' to the edge of the tube 16 furthest from the mouth end 16*a* of the filter unit. An inner diameter of the first portion 16*a* of the tube 16 is different from an inner diameter of the second portion 16*b* of the tube 16.

In the present example, an inner diameter of the second portion 16*b*, illustrated in FIG. 2 by arrow 13', is greater than an inner diameter of the first portion 16*a*, illustrated by arrow 'A'. The inner diameter 'A' of the first portion 16*a* may be in the range of about 5 mm to about 10 mm, about 6 mm to about 9 mm, or about 6 mm to about 9 mm. For example, the inner diameter of the first portion 16*a* may be about 8 mm. Inner diameter of the first portion may be selected to correspond to the outer diameter of the mouth end 17*a* of the smoking article 17. The inner diameter 'B' of the second portion 16*b* varies along the length of the second portion 16*b* in the present example. The largest inner diameter 'B' of the second portion 16*b*, can be in the range of about 6 mm to about 12 mm, about 6 mm to about 10 mm, or about 8 mm to about 10 mm. For example, the largest inner diameter 'B' of the second portion 2*b* may be about 9 mm.

In the present example, the outer diameter of the second portion 16*b*, is the same as the outer diameter of the first portion 16*a*.

In the present example, the second filter unit 15 further includes a sleeve 18. The sleeve 18 is formed from a sheet material such as plug wrap. In alternative examples, the sleeve 18 can be formed in other ways, for instance from plastic or other materials.

The second filter unit 15 also includes a downstream filter segment 19, arranged downstream of the tube 16 in the direction of mainstream smoke when the smoking article 17 is drawn on by a user with the second filter unit 15 attached to the smoking article 17. The downstream filter segment 19 has a longitudinal axis (not shown). The downstream filter segment 19 has a longitudinal end surface 19*a* furthest from the mouth end 16*a* of the second filter unit 15. In the present example, the tube 16 and the downstream filter segment 19 have a common longitudinal axis.

The sleeve 18 is wrapped around the tube 16 and the downstream filter segment 19. In the present example, an adhesive is provided between the sleeve 18 and the tube 16 and downstream filter segment 19 and in this way the sleeve 18 connects the tube 16 to the downstream filter segment 19.

In the present example, the end of the tube 16 furthest from the mouth end 16*a* of the second filter unit 15 extends beyond the end of the sleeve 18 furthest from the mouth end 16*a* of the second filter unit 15. In the present example, the tube 16 extends 0.5 mm beyond the sleeve 18. However, in alternative examples, the tube 16 may extend between about 0.5 and 10 mm, for instance between about 0.5 mm and 3 mm beyond the end of the sleeve 18 furthest from the mouth end 16*a* of the second filter unit 15, or may be flush with the edge of the sleeve 18 or stop short of the end of the sleeve 18 furthest from the mouth end 16*a* of the filter element 15. In the present example, the sleeve 18 fully surrounds the outer surface of the downstream filter segment 19.

The length of the downstream filter segment 19 may be selected according to the desired filtration performance of the second filter unit 15, and may be in the range 5 mm to 25 mm, or 10 mm to 15 mm. For example, the length of the downstream filter segment 19 may be about 12 mm.

The outer diameter of the downstream filter segment 19 may be substantially the same as the outer diameter of the tube 16. Either or both of the tube 16 and the downstream filter segment 19 may comprise a separate plug wrap (not shown) around which the sleeve 18 is wrapped.

The tube 16 and downstream segment 19 may be formed of filter material, in particular a fibrous filter material, as described herein. The tube 16 and/or downstream segment 19 can contain substances such as additives or agents for modifying the aerosol, in the present case smoke, generated by the smoking article 17. For example, a frangible capsule (not shown) as described elsewhere herein and containing a flavourant or other additive may be located within the downstream filter segment 19. The capsule can be located at a central longitudinal position within the downstream filter segment 19, or may be offset from the central longitudinal position.

In alternative examples, the second filter unit 15 may include alternative substances such as additives or agents for modifying the aerosol generated by the smoking article 17, such as granules of activated carbon or other adsorbents, humectants, diluents etc. The smoking article 17 can be a conventional cigarette in any of the smoking article formats described herein.

The discrete second filter unit 15 can be coupled or attached to the smoking article 17 by a user. In the present example, the tube 16 of the second filter unit 15 is arranged to receive a mouth end portion 17*a* of the smoking article 17 so that the second filter unit 15 and the smoking article 17 can be attached or coupled together by a user. The mouth end 17*a* of the smoking article 17, in the present example, abuts the longitudinal end surface 19*a* when the second filter unit 15 is connected to the smoking article 17. The user can select whether or not to attach the second filter unit 15 to the smoking article 17 prior to smoking the smoking article 17, and can in this way control the length of filter of the smoking article 17 and therefore the level of filtration of the aerosol generated by the smoking article 17, as well as any other modification of the aerosol performed by the second filter unit 15.

The second filter unit 15 may be attached to the smoking article 17 in any suitable way. This may include forming an interference fit between an inner surface of the tube 16 and an outer surface of the smoking article 17. In this case, the interference fit is such that a seal is formed at the interface between the inner surface of the tube 16 and the outer surface of the smoking article 17, which inhibits the ingress of gases (such as air) that would normally enter into the smoking article 17 via a gap between the outer surface of the smoking article 17 and the inner surface of the tube 16. The amount of air entering into a smoking article between the two neighbouring surfaces may be variable and/or unwanted. Restricting the ingress of air therefore provides a degree of control of the airflow into and/or through the smoking article 17.

The tube 16 has a longitudinal axis (not shown). The inner surface of the first portion 16*a* is substantially parallel to the longitudinal axis of the tube 16. The inner surface of the second portion 16*b*, is chamfered in that it is at an angle to the longitudinal axis of the tube 16, in the present example. The angle of intersection between a straight line following the inner surface of the second portion 16*b* of the tube 16 and the longitudinal axis of the tube 16 may be in the range of about 10° to about 80°, or about 20° to about 70°, or about 30° to about 60°. For example, the angle may be about 45°.

In the present example, the inner portion of the edge of the tube 16 furthest from the mouth end 16*a* of the second filter unit 16 is chamfered such that an inner diameter of the second portion 16*b*, illustrated by arrow 'B' is greater than an inner diameter of the first portion 16*a*, illustrated by arrow 'A'. This arrangement makes it easier for the user to insert an end 17*a* of the smoking article 17 into the tube 16, in order to couple the second filter unit 15 to the smoking article 17.

Figure 3A:
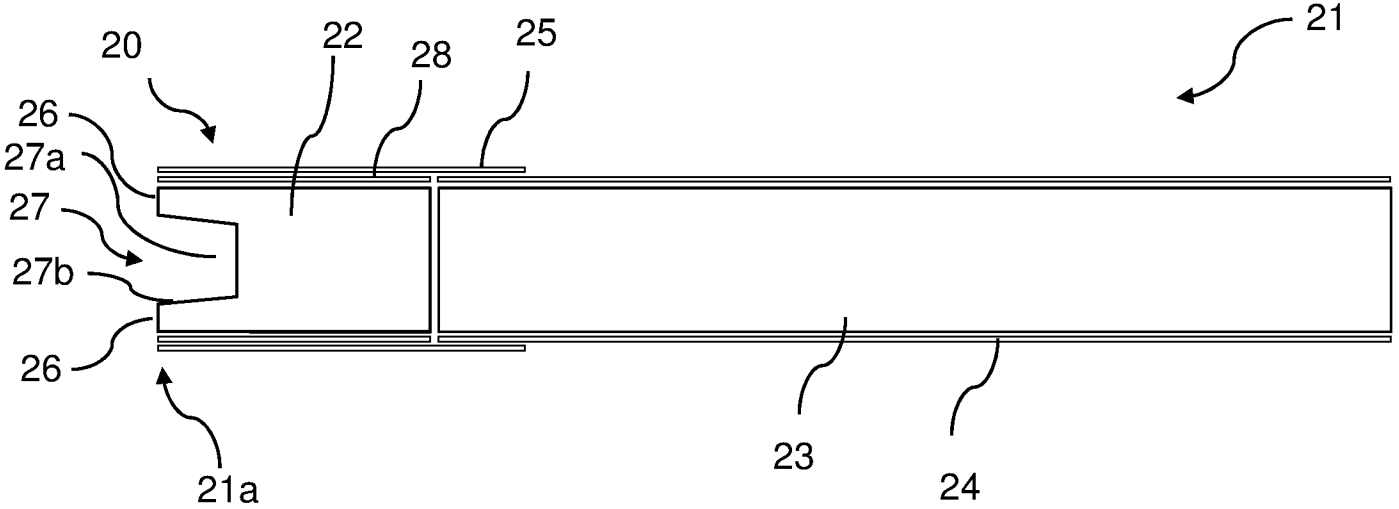
FIG. 3*a* is a side-on cross sectional view of a third filter unit including a filter body comprising a recess and where the third filter unit forms part of a smoking article.

FIG. 3*a* is a side-on cross sectional view of a third filter unit 20 forming part of a smoking article 21. The third filter unit 20 comprises a body 22 formed of filter material. The smoking article 21 includes a rod of aerosol generating material 23, in the present case cut tobacco, wrapped in a sheet material 24, in the present case cigarette paper. The rod 23 and third filter unit 20 are connected by tipping 25, which surrounds the third filter unit 20 and partially surrounds the rod 23. The smoking article 21 has a mouth end 21*a* to be inserted in the user's mouth when smoking. The body 22 of the third filter unit 20 has an end surface 26 at the end of the body 22 closest to the mouth end 21*a* of the smoking article 21 furthest from the rod 23 and a recess 27 formed in the end surface 26. The recess 27 is a hollow depression in the body 22. The recess 27 extends into, but not entirely through, the body 22. In the present example, the body 22 is cylindrical, and the end surface 26 is a longitudinal end surface of the body 22.

In the present example, the recess 27 has the shape of a conical frustum, and has an inner base surface 27*a* and an inner side surface 27*b*. In other examples, the recess 27 may have the shape of other frustums, and may have multiple side surfaces. Alternatively, the recess may be cylindrical, conical or hemispherical in shape.

The recess 27 may be formed in the filter material of the body 22 by indentation. In this case, the filter material of the body 22 may be compressed during formation of the recess 27. In other words, the filter material at or close to an inner surface of the recess 27, for instance at a first longitudinal end surface 26 of the body 22, is denser than the filter material in other areas of the body 22, such as the end of the body 22, or second longitudinal end surface of the body 22 furthest from the first longitudinal end surface 26. Alternatively, the recess 27 can be formed by removing filter material from the body 22 at the end surface 26. The recess 27 can direct smoke to a particular portion of the body 22 in which the recess 27 is located, by reducing the volume of material in that part of the body 22, and enable particular formations of smoke from the mouth end 21*a* of the smoking article 21. The formation of the recess 27 can result in a net increase or decrease in the resistance to draw of the body 22 of filter material. In this way, the formation of the recess 27 can be used to adjust the resistance to draw of the body 22 of filter material after the body 22 has been formed. The shape of the recess 27 may influence whether it increases or decreases the resistance to draw, with deeper, narrower recesses being more likely to reduce the resistance to draw than shallower, wider recesses. The resistance to draw may be altered by at least 5 mmWG by the formation of the recess 27, or by at least 6, 7, 8 or 9 mmWG. In the examples of the recess provided herein, the recess can be arranged to alter the resistance to draw by at least 10 mmWG. In the examples of the recess provided herein, the recess can be arranged to reduce the resistance to draw by at least 5 mmWG, or at least 10 mmWG.

The body 22 may include a smoke modifying substance or additive (not shown) disposed within the filter material of the body 22. The smoke modifying substance or additive may be any smoke modifying additive, such as flavours or other additives, as described herein.

The third filter unit 20 may further include a sleeve 28, such as plug wrap, which is wrapped around the body 22. In the present example, the body 22 is flush at the mouth end 21*a* of the smoking article with the edge of the sleeve 28. In other examples, the sleeve 28 and/or tipping 25 may extend beyond an end of the body 22. The space thus formed by the sleeve 28 and/or tipping 25 extending beyond an end of the body 22, such as the longitudinal end surface 26, may be arranged to receive a filter insert, such as that illustrated in FIG. 1*e*.

Figure 3B:
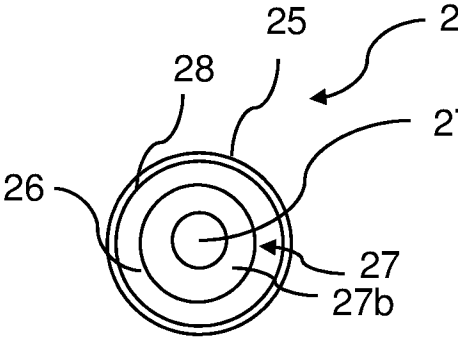
FIG. 3*b* is an end-on view of the third filter unit of FIG. 3*a;*

FIG. 3*b* is an end-on view of the third filter unit 20.

Figure 3C:
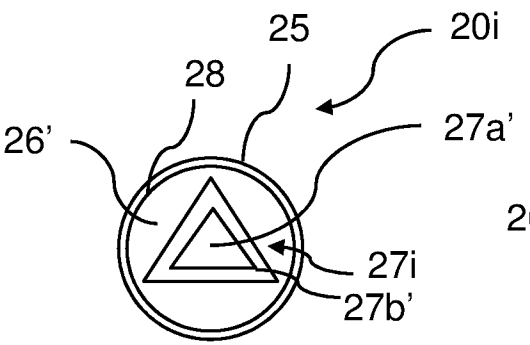
FIG. 3*c* is an end-on view of another third filter unit design, this design having a triangular shaped recess.

FIG. 3*c* is an end-on view of another design for a third filter unit 20*i*, in this case having a triangular shaped recess having an inner base surface 27*a*' and inner side surfaces 27*b*' and longitudinal end surface 26'.

Figure 3D:
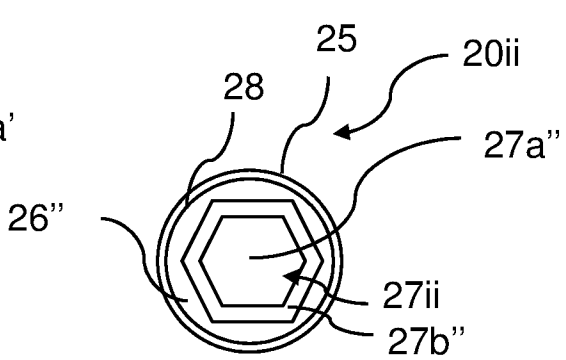
FIG. 3*d* is an end-on view of another third filter unit design, this design having a hexagonal shaped recess.

FIG. 3*d* is an end-on view of another design for a third filter unit 20*ii*, in this case having a hexagonal shaped recess having an inner base surface 27*a*" and inner side surfaces 27*b*" and longitudinal end surface 26".

FIG. 3*e* is an end-on view of another design for a third filter unit 20*iii*, this design having a substantially cone shaped recess 27*iii*. FIG. 3*e*' is a side-on cross sectional view of the third filter unit 20*iii* of FIG. 3*e*. The recess 27*iii* of FIG. 3*e* extends substantially across the whole end surface of the body 22*iii*. The cone shape of the recess 27*iii* is formed from a first conical frustum extending from the end surface approximately two thirds of the depth of the recess and then capped by a second cone having a steeper slant than the first conical frustum extending for the final third of the depth into the body 22*iii*. The slant angle of the first conical frustum can be between 30° and 60°, in the present case about 45°, with respect to the longitudinal axis of the cone. The slant angle of the second cone can be between 20° and 40° from the longitudinal axis of the cone, in the present case about 30°. The body 22*iii* of filter material has reflective symmetry about the line 'X' which is perpendicular to the longitudinal axis of the body 22 and infinite rotational symmetry about the longitudinal axis.

FIG. 3*f* is an end-on view of another design for a third filter unit 20*iv*, this design having a recess 27*iv* having a first portion in the form of a frustum cone, a second portion in the form of a cylinder and a third portion in the form of a cone. FIG. 3*f* is a side-on cross sectional view of the third filter unit 20*iv* of FIG. 3*f*. The first portion can extend a depth of approximately two fifths of the depth of the recess 27*iv* and have a slant angle of between 30° and 60° from the longitudinal axis of the cone, in the present case about 45°. The second portion in the form of a cylinder has a depth of approximately two fifths of the depth of the recess 27*iv* and a diameter of about 50% of the diameter of the filter unit 20*iv*, centred on the longitudinal axis. The third portion in the form of a cone has a depth of approximately one fifth of the depth of the recess 27*iv* and a slant angle of between 45° and 75° from the longitudinal axis of the cone, in the present case about 60°. The body 22*iv* of filter material has reflective symmetry about the line 'X' which is perpendicular to the longitudinal axis of the body 22*iv* and infinite rotational symmetry about the longitudinal axis.

FIG. 30 is an end-on view of another design for a third filter unit 20*v*, this design having a recess 27*v* having a first portion in the form of a cylinder and a second portion in the form of a cone. FIG. 3*g*' is a side-on cross sectional view of the third filter unit 20*v* of FIG. 3*g*. The first portion in the form of a cylinder has a depth of approximately three fifths of the depth of the recess 27*v* and a diameter of about 70% of the diameter of the filter unit 20*v*, centred on the longitudinal axis. The second portion in the form of a cone has a depth of approximately two fifths of the depth of the recess 27*v* and a slant angle of between 30° and 60° from the longitudinal axis of the cone, in the present case about 45°. The body 22*v* of filter material has reflective symmetry about the line 'X' which is perpendicular to the longitudinal axis of the body 22*v* and infinite rotational symmetry about the longitudinal axis.

Figure 3J:
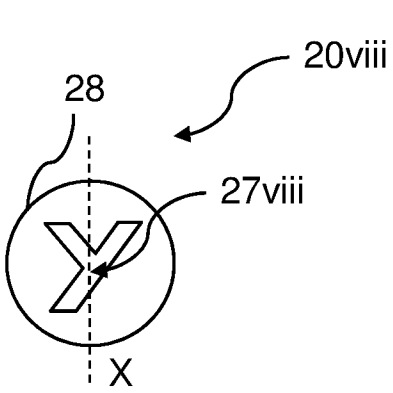
FIG. 3*j* is an end-on view of another third filter unit design, this design having a recess in the form of the capital letter 'Y'.
Figure 3I:
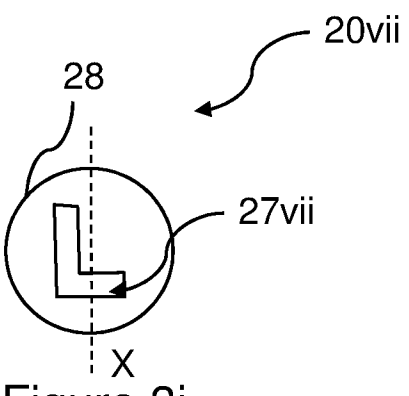
FIG. 3*i* is an end-on view of another third filter unit design, this design having a recess in the form of the capital letter 'L'.
Figure 3H:
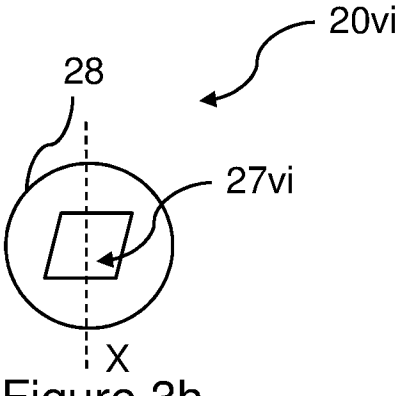
FIG. 3*h* is an end-on view of another third filter unit design, this design having a recess in the form of a rhomboid prism.
Figure 3J:
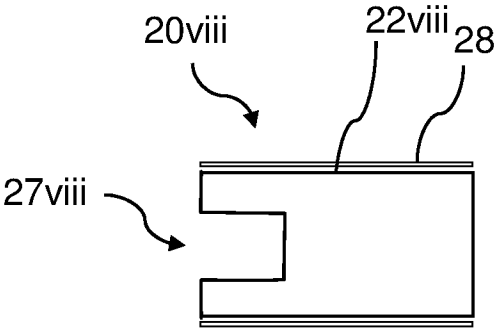
Figure 3I:
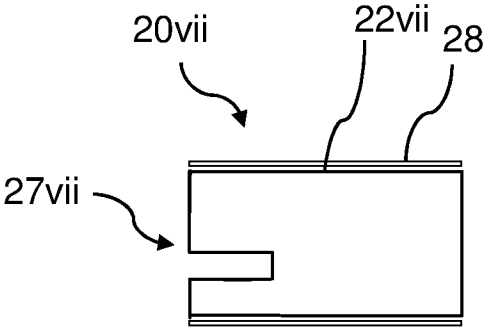
Figure 3H:
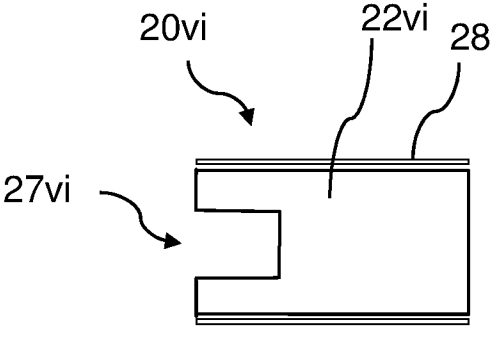

FIG. 3*h* is an end-on view of another design for a third filter unit 20*vi*, this design having a recess 27*vi* in the form of a rhomboid prism. FIG. 3*h*' is a side-on cross sectional view of the third filter unit 20*vi* of FIG. 3*h*. The body 22*vi* of filter material has no lines of reflective symmetry. For instance, there is no reflective symmetry about any lines 'X' perpendicular to the longitudinal axis of the body 22*vi*. The body 22*vi* has order 2 rotational symmetry about the longitudinal axis, in that a rotation of 180° about the longitudinal axis maps the body 22*vi* back onto itself.

FIG. 3*i* is an end-on view of another design for a third filter unit 20*vii*, this design having a recess 27*vii* in the form of the capital letter 'L'. FIG. 3*i*' is a side-on cross sectional view of the third filter unit 20*vii* of FIG. 3*i*. The body 22*vii* of filter material has no lines of reflective symmetry. For instance, there is no reflective symmetry about any lines 'X' perpendicular to the longitudinal axis of the body 22*vii*. The body 22*vii* has order 1 rotational symmetry, or no rotational symmetry, about the longitudinal axis, in that only a rotation of 360° about the longitudinal axis maps the body 22*vii* back onto itself.

FIG. 3*j* is an end-on view of another design for a third filter unit 20*viii*, this design having a recess 27*viii* in the form of the capital letter 'Y'. FIG. 3*j*' is a side-on cross sectional view of the third filter unit 20*viii* of FIG. 3*j*. The body 22*viii* of filter material has no lines of reflective symmetry. For instance, there is no reflective symmetry about any lines 'X' perpendicular to the longitudinal axis of the body 22*viii*. The body 22*viii* has order 1 rotational symmetry, or no rotational symmetry, about the longitudinal axis, in that only a rotation of 360° about the longitudinal axis maps the body 22*viii* back onto itself.

The third filter units 20 and 20*i* to *viii* described herein having a recess formed in an end surface can be used to form components of other filter units and filter inserts described herein. For instance, the third filter units 20 and 20*i* to *viii* described herein having a recess formed in an end surface can be used as the upstream filter segment 8 of the first filter unit 1 described with reference to FIG. 1*a*, as the filter insert 10 as described with reference to FIG. 1*e*, or as the downstream filter segment 19 of the second filter unit 15 described with reference to FIG. 2. In each case, the recess would be arranged to face the mouth end of the product.

The hardness of the third filter units 20 and 20*i* to *viii* described herein having a recess formed in an end surface, as measured according to the above process and with the filter unit forming the mouth-end filter component of a cigarette, can be between about 80% and 92%, in particular between about 82% and 88% and in some examples about 82%, 85% or 88%. The process of indenting the filter material to form the recess can increase the hardness of the filter by between about 2% and about 10% depending on the shape of the recess, between about 2% and about 6% or about 2%, about 5% or about 6%.

Although described has having a single recess formed in an end surface thereof, the filter units can be provided with more than one recess. For instance, the end surface can be provided with between two and twelve separate recesses, either formed simultaneously or in separate process steps. Alternatively or in addition, a recess in the end surface can include portions having different depths into the end surface.

Figure 4:
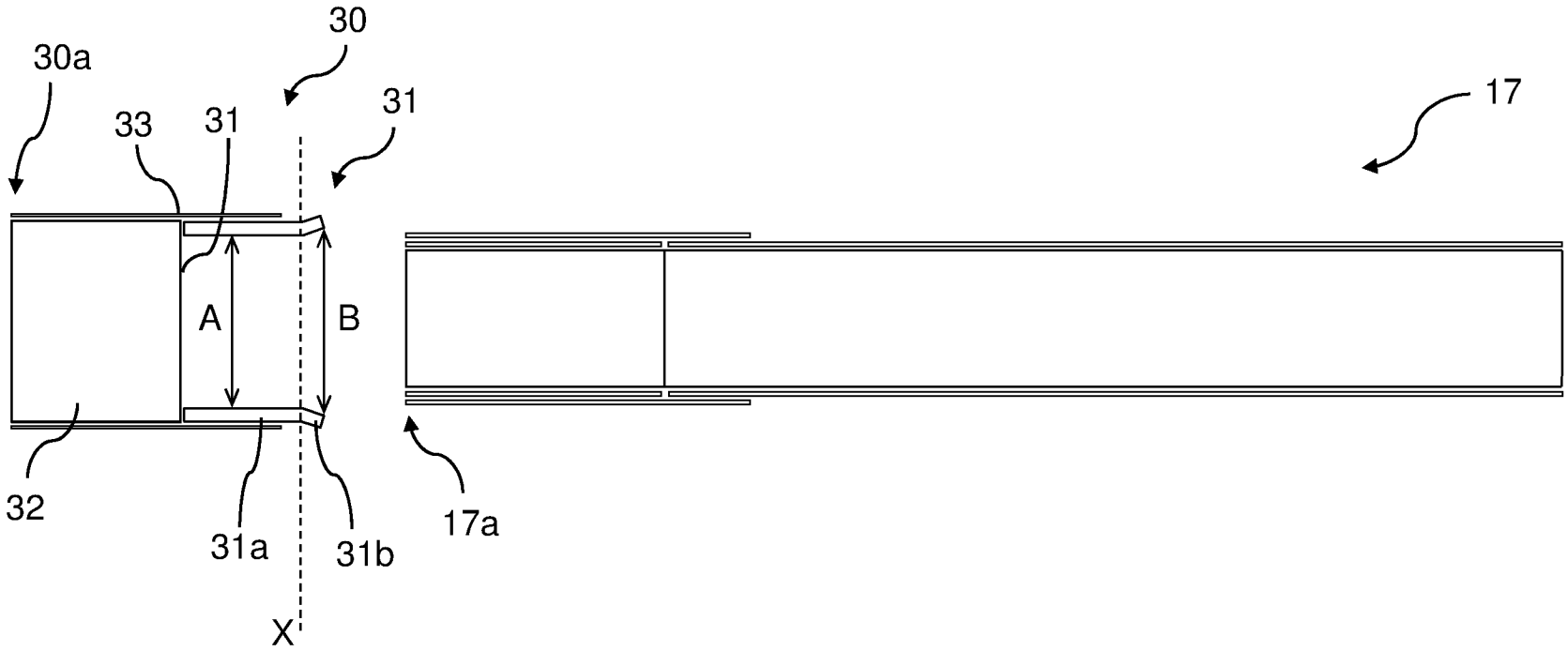
FIG. 4 is a side-on cross sectional view of a fourth filter unit including a tube formed from sheet material and provided as a discrete component for use with a separate smoking article.

FIG. 4 is a side-on cross sectional view of a fourth filter unit 30, including a tube 31 formed from sheet material, and provided as a discrete component for use with a separate smoking article 17 as described with reference to FIG. 2. The fourth filter unit 30 has a mouth end 30*a* and comprises a tube 31 having a first portion 31*a* and a second portion 31*b*. An inner diameter of the first portion 31*a* is different from an inner diameter of the second portion 31*b*. The fourth filter unit 30 also includes a downstream filter plug 32 arranged closer to the mouth end 30*a* of the filter unit 30 than the tube 31 and formed from filter material. The fourth filter unit 30 further comprises a sleeve 33 partially surrounding the tube 31 and surrounding the downstream filter plug 32. The tube 31 of the present example can be formed from a sheet material such as paper, card, cardboard, plastic or similar materials.

The fourth filter unit 30 can be coupled or attached to another tobacco industry product, such as smoking article 17, by a user. The tube 31 is arranged to receive a portion of the smoking article 17, for instance the mouth end 17*a* of the smoking article 17, so that the filter unit 30 and the smoking article 17 can be attached or coupled together by a user. The fourth filter unit 30 is configured to modify one or more properties of an aerosol, such as smoke, which is generated by the smoking article 17.

In the present example, the tube 31 is formed from a sheet material separate from the sleeve 33, enabling the tube 31 to be formed of stiffer material than may be possible for use in wrapping the downstream filter plug 32. An inner diameter 'B' of the second portion 31*b* is greater than an inner diameter 'A' of the first portion 31*a*. This arrangement makes it easier for the user to couple the fourth filter unit 30 to the smoking article 17. In the present example, an outer diameter 'B' of the second portion 31*b* is greater than an outer diameter of the first portion 31*a*. This arrangement may be referred to as the tube 31 having a 'widened end'. The dimensions of the tube 31 of FIG. 4 can correspond to the dimensions of the tube 16 described with reference to FIG. 2.

The tube 31 formed from sheet material described with reference to FIG. 4 can be used in place of the tube 2 at the mouth end of the smoking article 3 described with reference to FIG. 1*a*.

FIGS. 5*a* to 5*e* are perspective views of a first apparatus 40 for shaping a tobacco industry product 41. The tobacco industry product 41 may be (for example) a smoking article, a filter, or a tube, or other components described herein. The filter may be an individual filter unit, or may be part of a smoking article. The tube may be part of another tobacco industry product, e.g. a filter unit or a smoking article. Any of these tobacco industry products 41 may have a longitudinal axis. Any of these tobacco industry products may have a longitudinal end surface. Tubular components may also have an inner surface around the inside of the tube. The first apparatus 40 can be used, for instance, to form any of the tubes 2, 2', 16, 31 of the first, second and fourth filter units 1, 15, 30 described herein, or the recess 27-27*viii* formed in the filter body 22-22*viii* of the third filter units 20-20*viii* described herein.

Figure 5A:
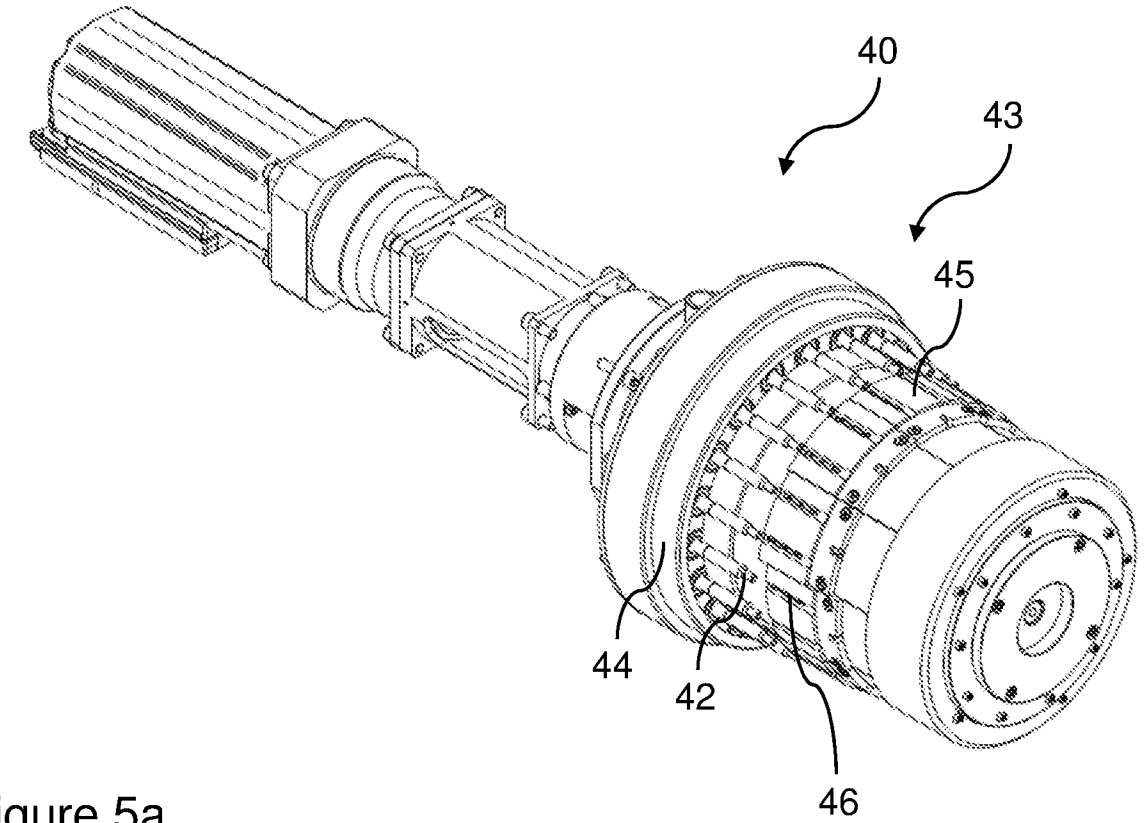
FIGS. 5*a* to 5*e* are perspective views of a first shaping apparatus for shaping a tobacco industry product.
Figure 5B:
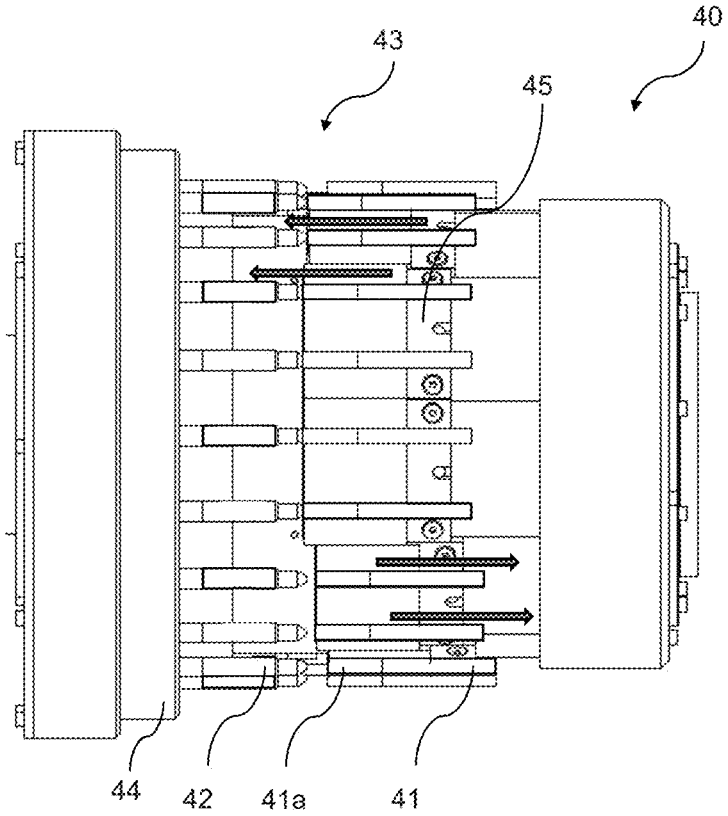
Figure 5C:
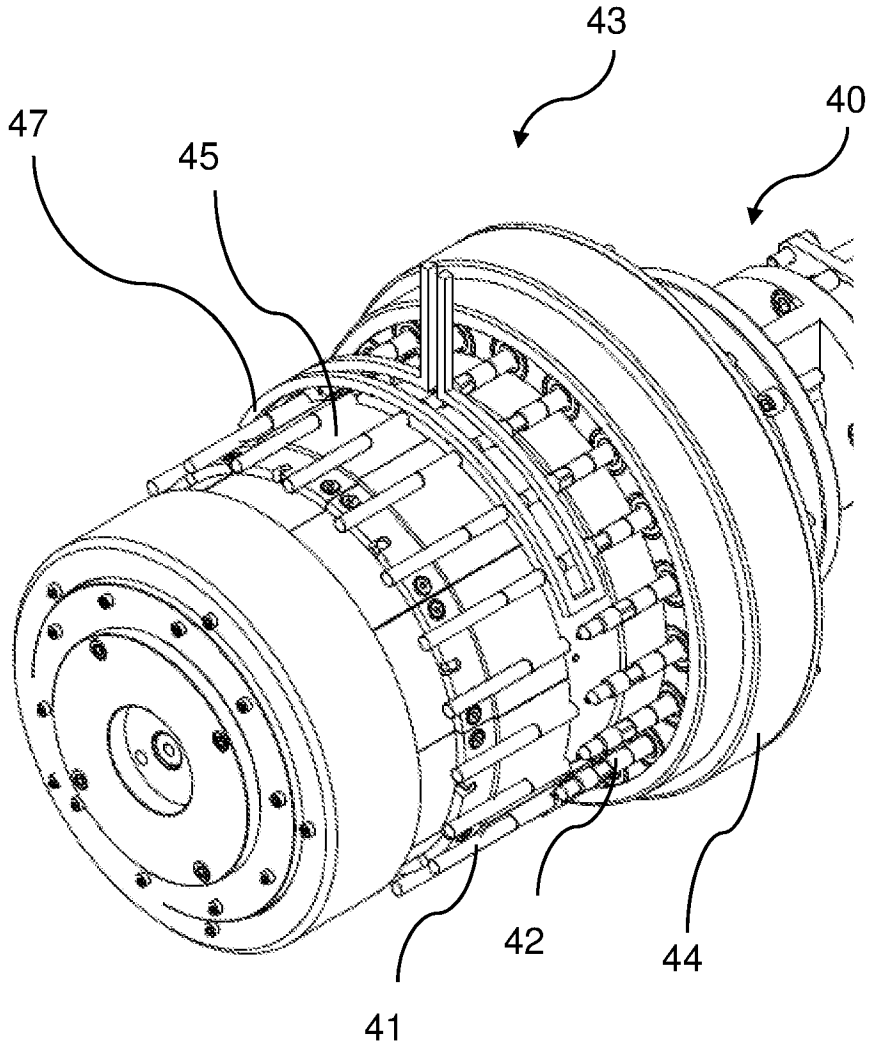

Referring to FIG. 5*a*, the apparatus 40 comprises a shaping head 42 configured to change the shape of a first end of the tobacco industry product 41 (not shown in this Figure). The apparatus 40 further comprises an actuator arrangement 43 configured to move the shaping head 42 and/or tobacco industry product 41. The actuator arrangement 43 is configured to move the shaping head 42 and/or tobacco industry product 41 in a direction substantially parallel to a longitudinal axis of the tobacco industry product 41 such that the shaping head 42 is brought into contact with a first end 41*a* of the tobacco industry product 42 in order to change the shape of the first end 41*a*.

Alternatively or in addition to the above, the actuator arrangement 43 can be configured to move the shaping head 42 and/or tobacco industry product 41 such that the shaping head 42 is brought into contact with a first longitudinal end surface and/or an inner surface of the tobacco industry product 41 in order to change the shape of the first longitudinal end surface and/or an inner surface.

In some examples, a receiving unit is arranged to receive and grip the tobacco industry product 41, so as to hold tobacco industry product 41 in position while it is shaped. This may be achieved by mechanical means, such as a clamp, or alternatively by means such as vacuum suction, as described in more detail below.

In use, when the shaping head 42 is brought into contact with the first end 41*a* of the tobacco industry product 41, the pressure exerted on the end 41*a* of the tobacco industry product 41 by the shaping head 42 deforms the material of the tobacco industry product 41, thereby changing a shape of the end of the tobacco industry product 41. Changing the shape of the end of the tobacco industry product 41 may, for instance, include changing an inner and/or outer diameter of the tobacco industry product 41, as well as forming an indentation in the end 41*a*.

The actuator arrangement 43 may be configured to move the shaping head 42 and/or tobacco industry product 41 in a reciprocating fashion. In other words, actuator arrangement 43 may be configured to move the shaping head 42 and/or tobacco industry product 41 so that they are first brought into contact with each other and are then moved apart from each other.

The shaping head 42 may be cylindrical in shape. In the present example, the shaping head 42 is substantially cylindrical in shape, and the end of the shaping head 42 has a chamfered profile. In other words, the shaping head 42 comprises a surface which is angled with respect to a side surface and a longitudinal end surface thereof.

In other exemplary arrangements, the shaping head 42 may be conical in shape. The shaping head 42 may have the shape of a frustum, such as a conical frustum. The shaping head 42 may be hemispherical in shape or may have a shape which has relatively low orders of rotational symmetry or no rotational symmetry. For instance, when forming the third filter units 20' and 20" of FIGS. 3*c* and 3*d* herein, the end of the shaping head 42 would have a triangular frustum shape with order 3 rotational symmetry or a hexagonal frustum shape with order 6 rotational symmetry. The shaping head 42 can have, for instance, order 1 (also referred to herein as having no rotational symmetry), 2, 3, 4, 5, 6, 7, 8 or infinite/continuous rotational symmetry.

In the present example, the shaping head 42 has a longitudinal axis (not shown). The apparatus 40 is configured to rotate the shaping head 42 about its longitudinal axis, for instance for shaping heads 42 having infinite/continuous rotational symmetry. Rotating the shaping head 42 when the shaping head 42 is brought into contact with the end of the tobacco industry product 41 can provide a more even change in the shape of the end of the tobacco industry product 41, resulting in a uniform end profile, compared to a fixed shaping head 42. The shaping heads 42 described herein can be rotated at anywhere from 50 rpm to 1000 rpm or more, for instance from 200 rpm to 600 rpm or 400 rpm to 500 rpm.

However, the apparatus 40 can be configured such that the shaping head 42 is fixed when the shaping head 42 has a relatively low order of symmetry, for instance order 1, 2, 3, 4, 5, 6, 7, 8 rotational symmetry. A known method of applying a shape to a filter which is visible from the mouth end of the filter is to create a tube filter having that shape running through the centre as a bore. However, in such cases, the standard cigarette making process requires such a shape to have at least reflectional symmetry about a plane through which the axis of the filter passes, otherwise the shape will not be the same when the tube is used in different orientations. The use of a shaping head 42 which can be applied directly to a filter body addresses this issue, meaning that shapes with order 1 rotational symmetry can be applied uniformly to cigarette filters.

The shaping heads described herein can be formed from a material such as metal, for instance stainless steel. The material can have a low coefficient of friction (i.e. non-stick) property or have a coating having a low coefficient of friction. The coefficient of friction of the material forming the body and/or coating of the shaping head can be less than 0.2 or less than 0.1. The material forming the body and/or coating of the shaping head can be thermally stable to at least 350° C. The material forming the body and/or coating of the shaping head can be capable of being heated via induction, as described further below.

Figure 5D:
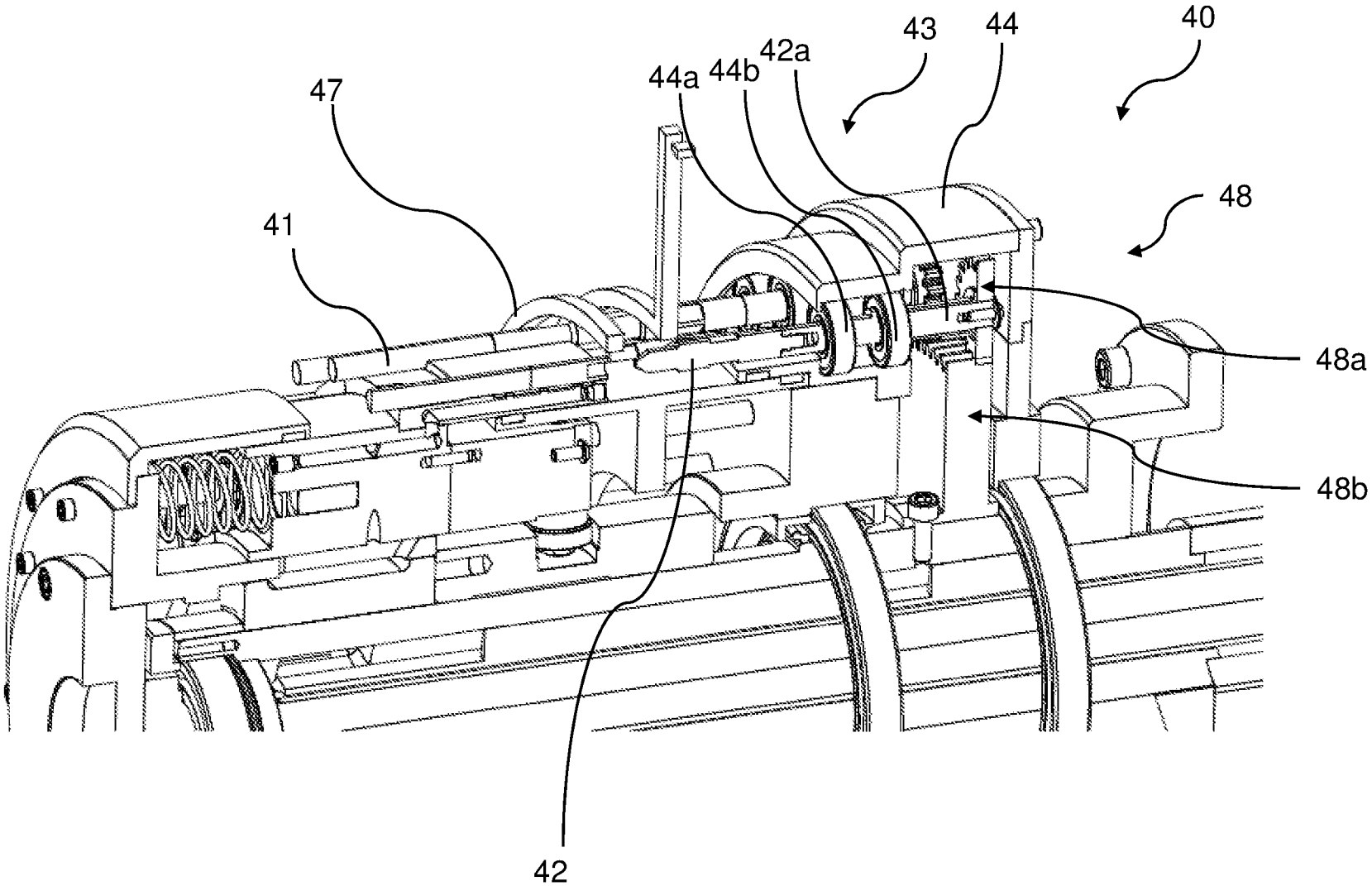
Figure 5E:
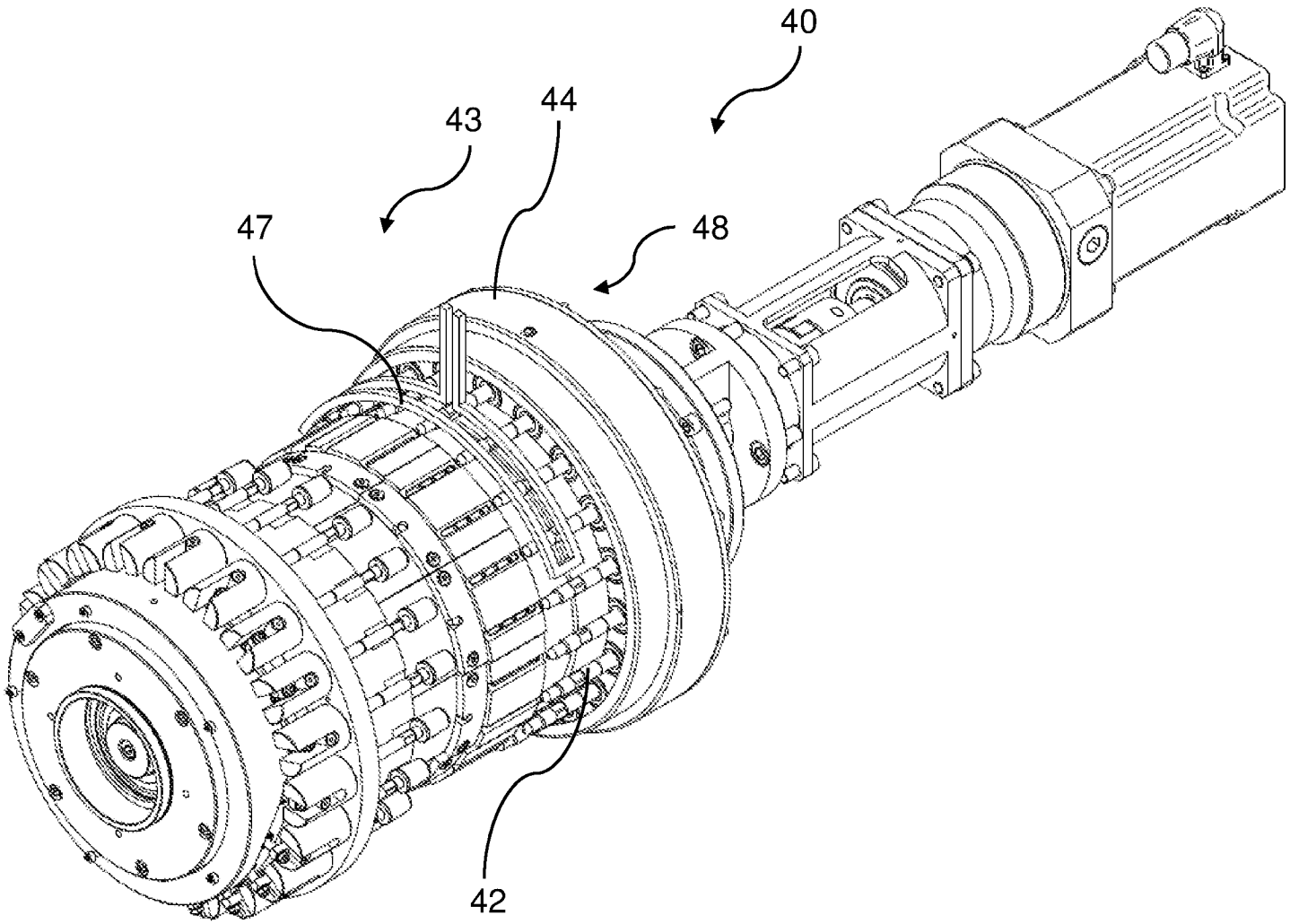
Figure 5F:
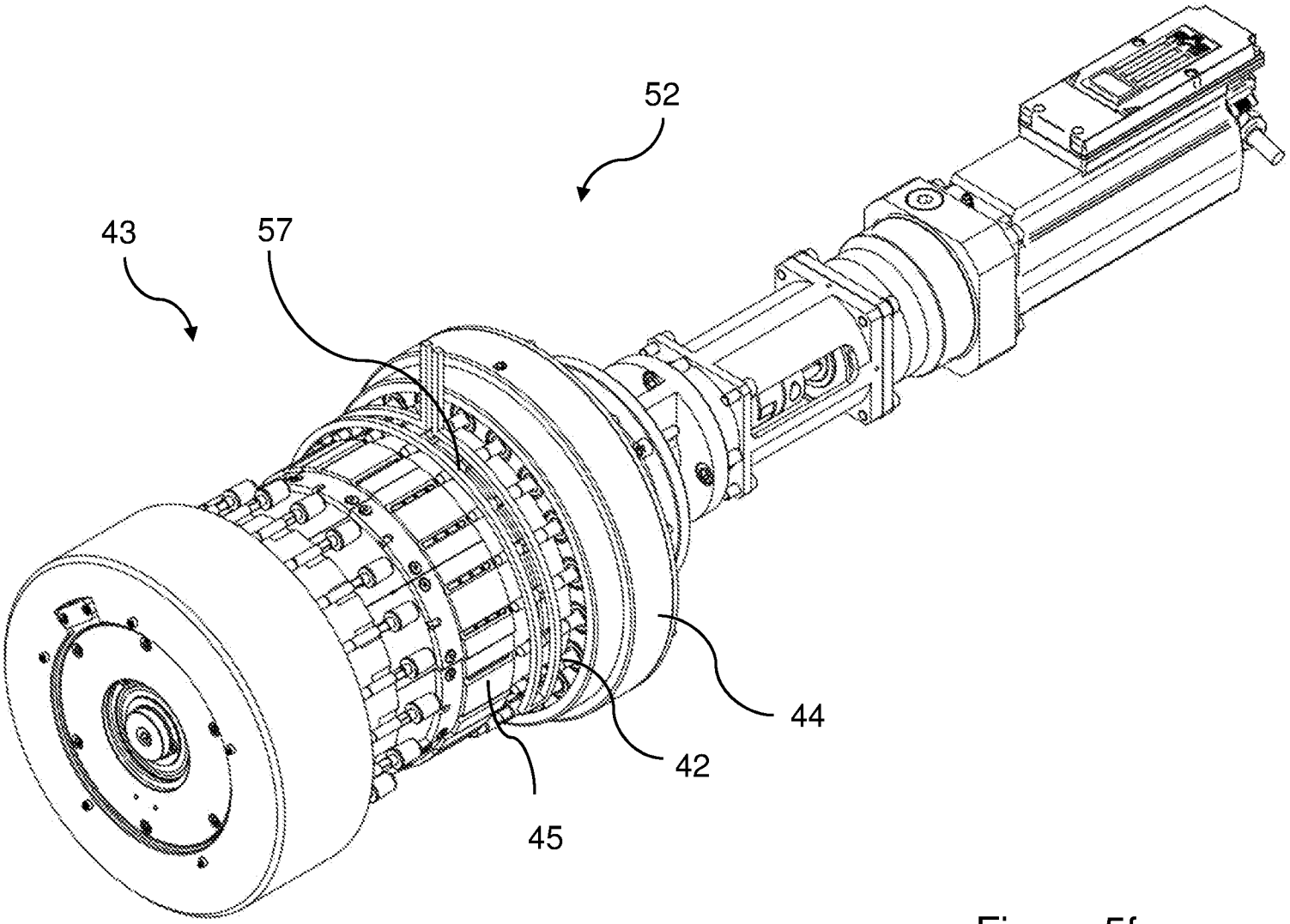
FIGS. 5*f* and 5*g* are perspective views of a second shaping apparatus for shaping a tobacco industry product.
Figure 5G:
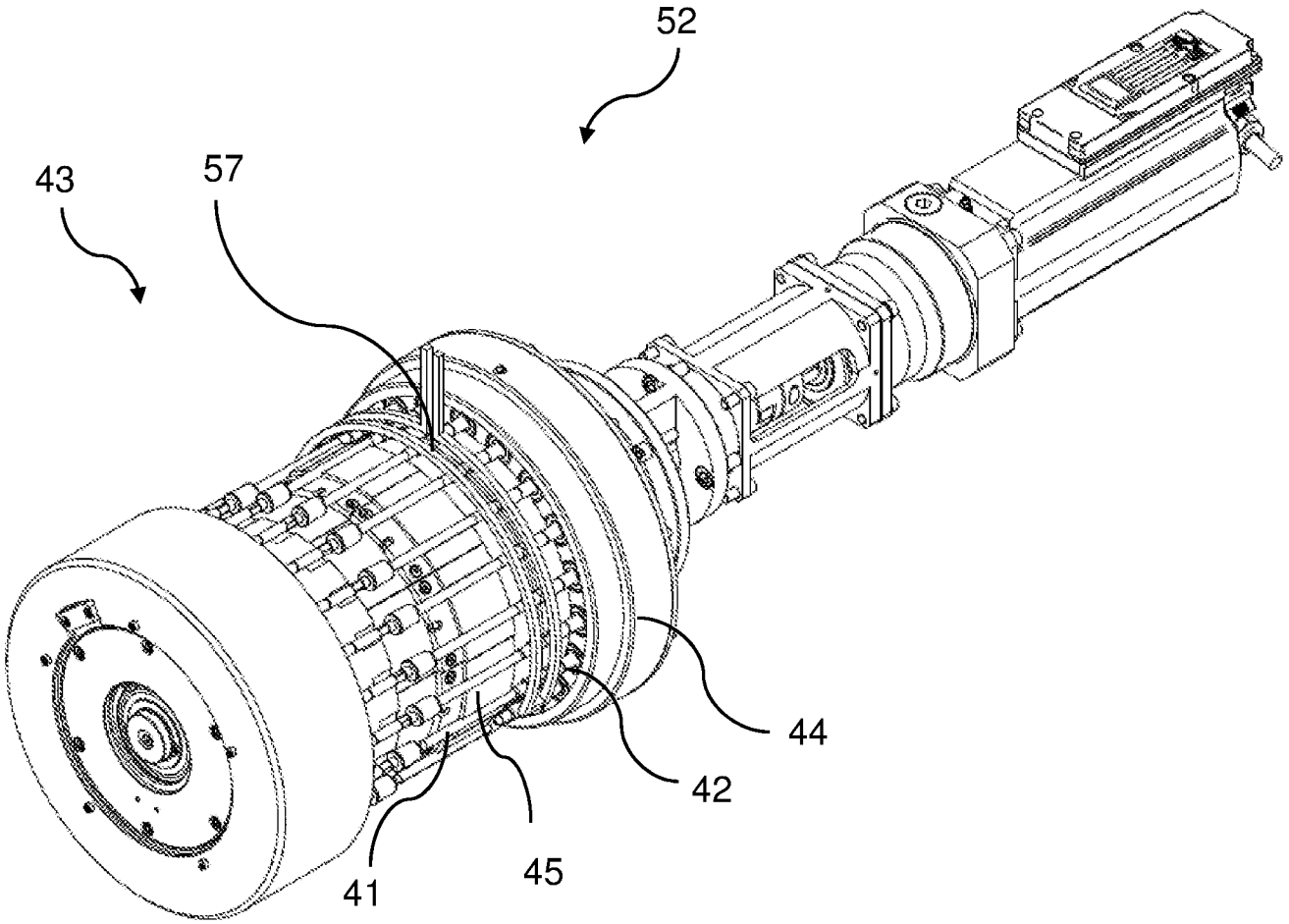
Figures 6A, 6B, 6C:
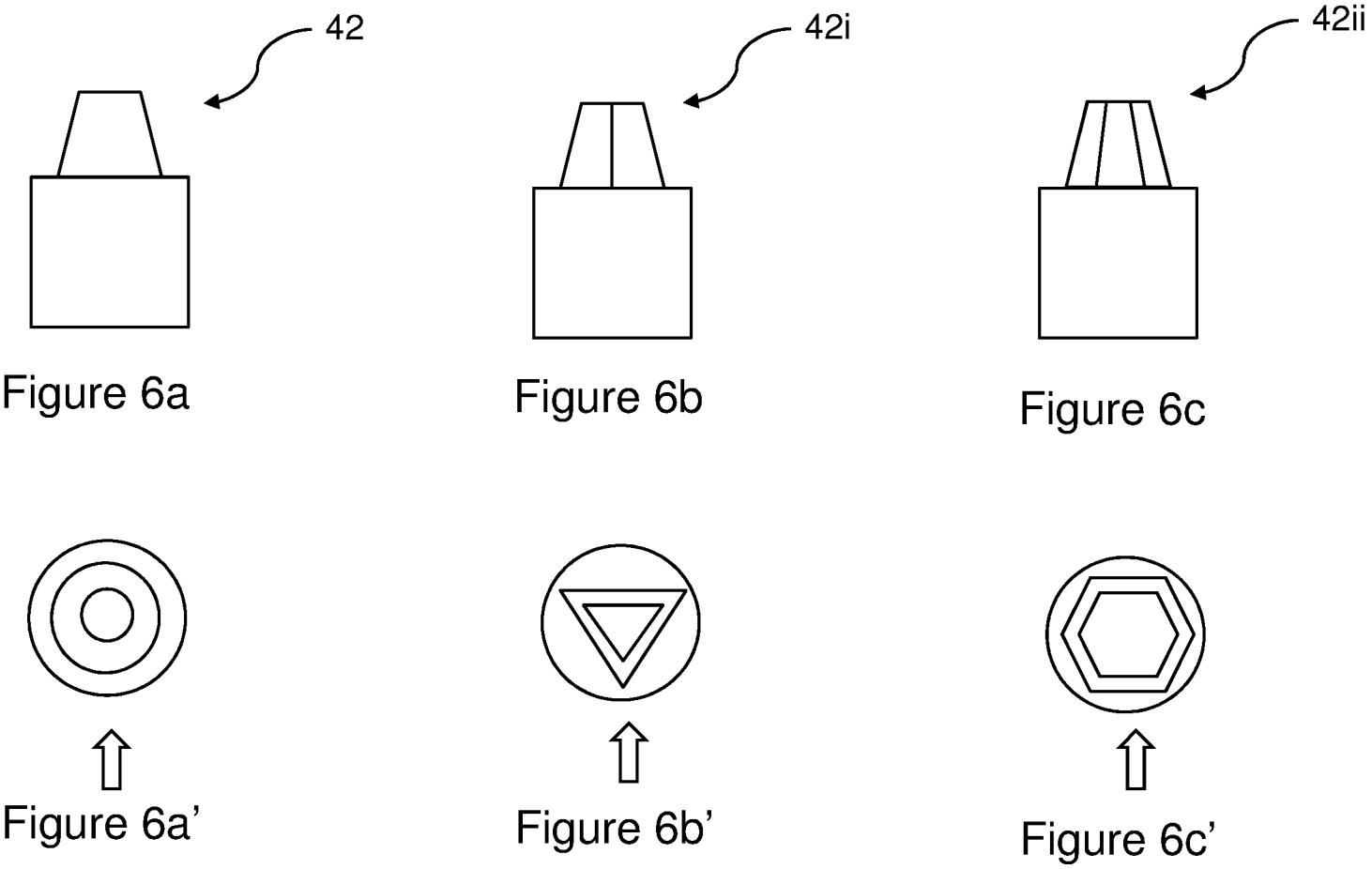
FIGS. 6*a* to 6*o* are side-on views of respective first to fifteenth shaping heads for use with the first and second apparatus of FIGS. 5*a* to 5*e* and FIGS. 5*f* and 5*g*, the side on views being from the direction of the respective arrows of FIGS. 6*a*' to 6*o*'.
Figures 6D, 6E, 6F, 6G:
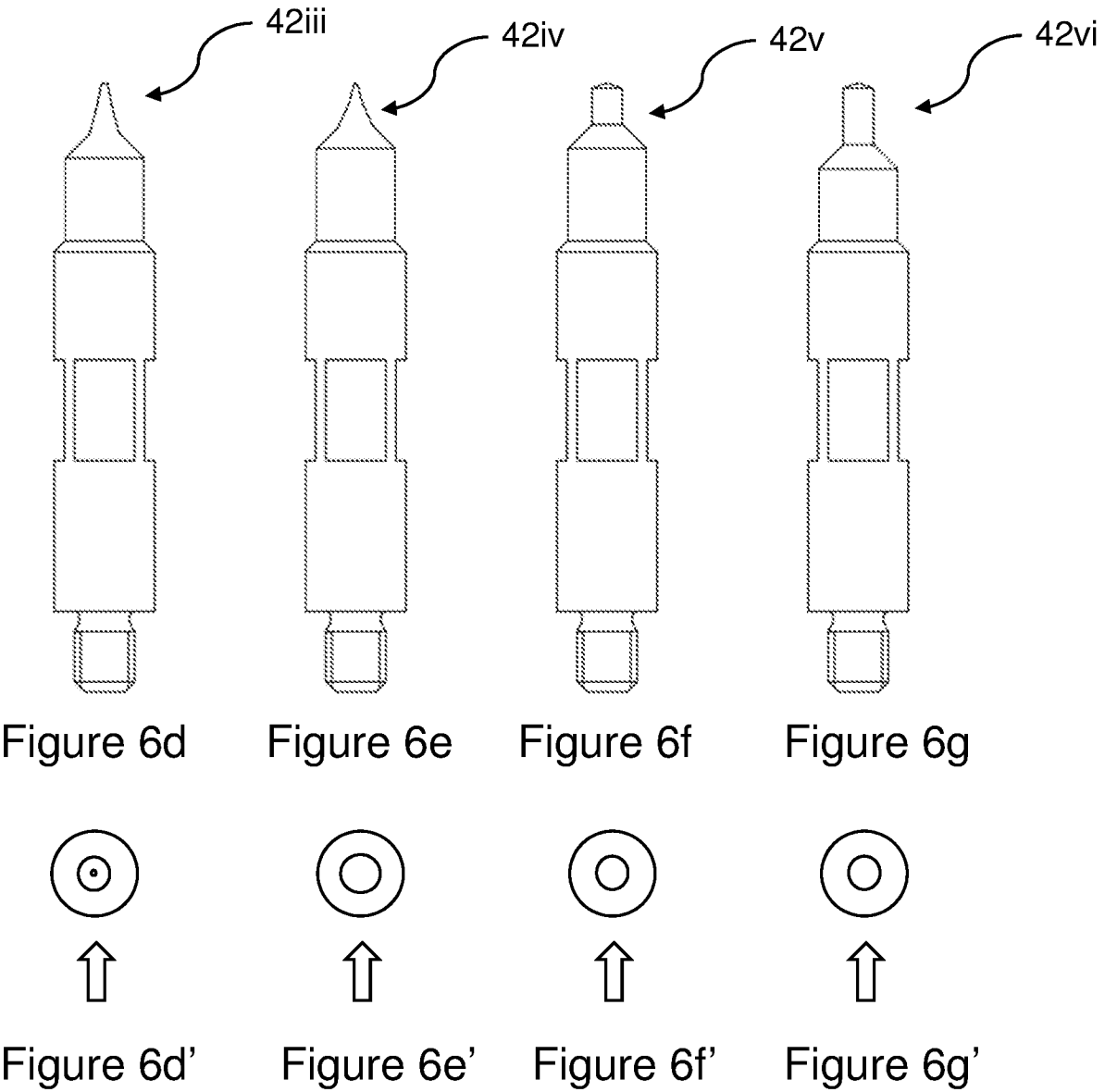
Figures 6H, 6I, 6J, 6K, 6L:
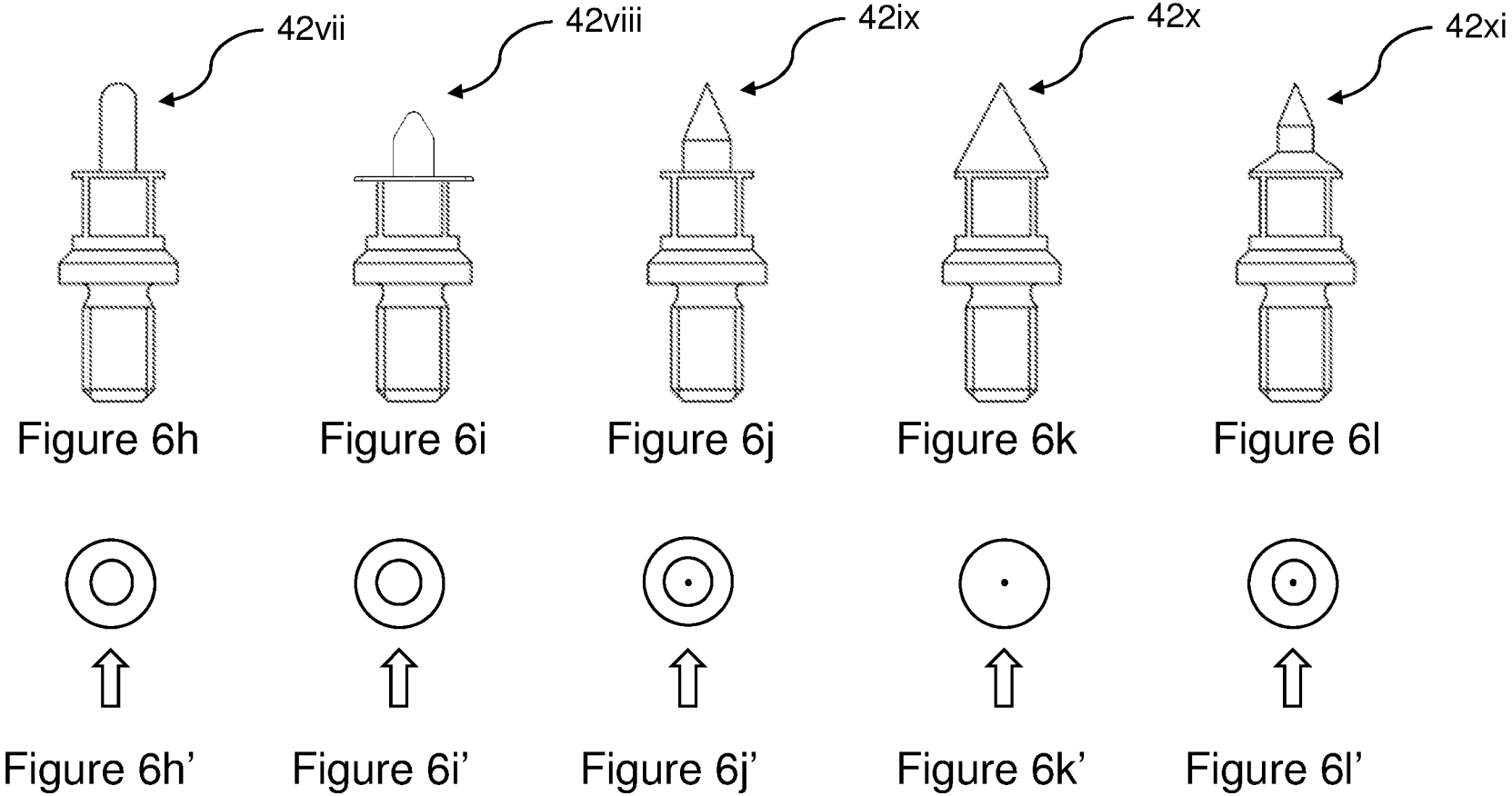
Figures 6M, 6N, 6O:
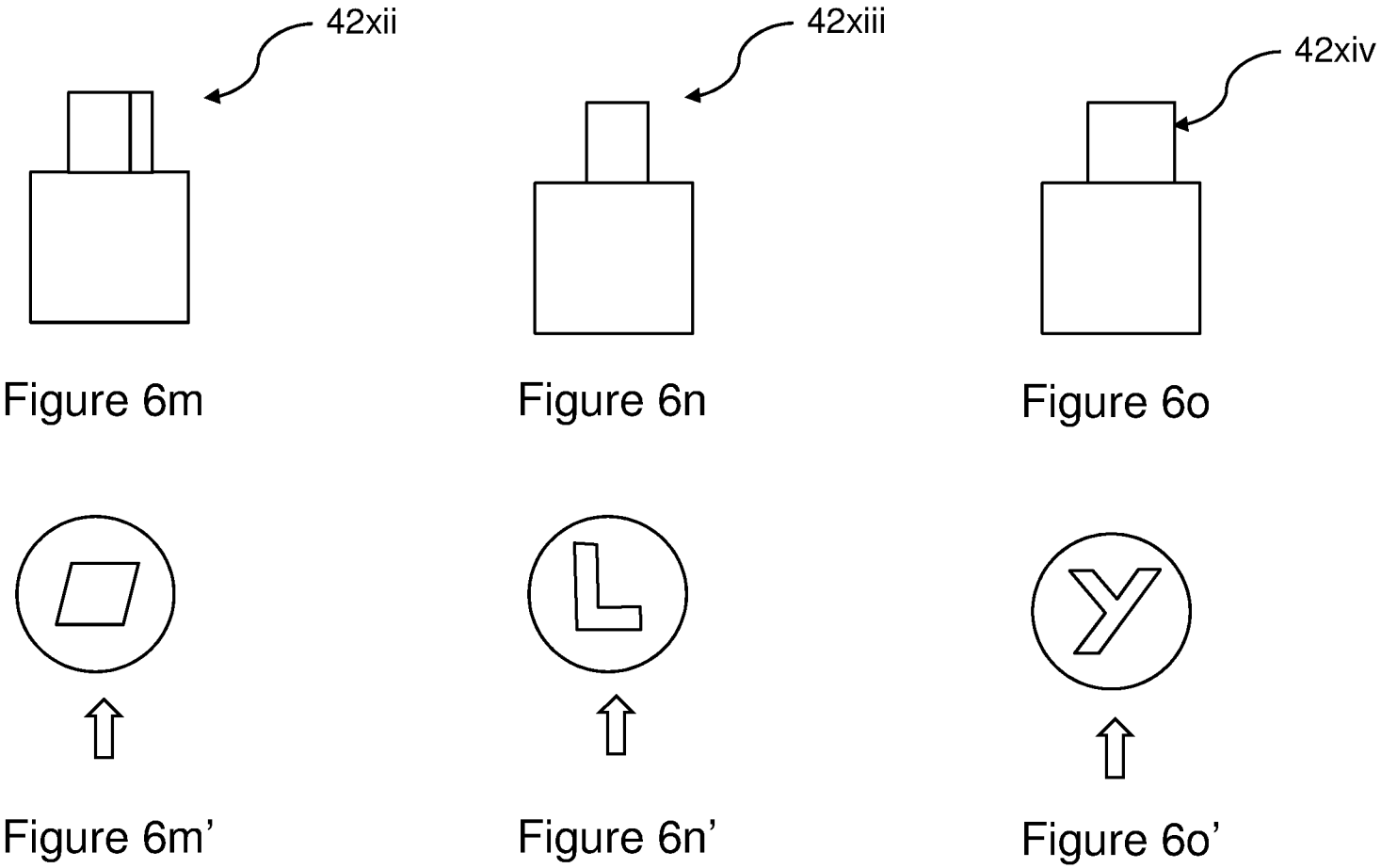

FIGS. 6*a* to 6*o* are side-on views of respective first to fifteenth shaping heads 42, 42*i* to 42*xiv* for use with the first apparatus of FIGS. 5*a* to 5*d* or the second apparatus of FIGS. 5*e* to 5*g*, the side on views being from the direction of the respective arrows of FIGS. 6*a*' to 6*o*', which are end-on views of the respective first to fifteenth shaping heads 42, 42*i* to 42*xiv* of FIGS. 6*a* to 6*o*.

The first shaping head 42, illustrated in FIGS. 6*a* and 6*a*', comprises a conical frustum shape, and can be used to form the third filter unit 20 of FIGS. 3*a* and 3*b*. The first shaping head 42 is arranged to be spinning when brought into contact with a body of filter material to form a recess. The second shaping head 42*i*, illustrated in FIGS. 6*b* and 6*b*', comprises a three-sided pyramidal frustum shape, and can be used to form the third filter unit 20*i* of FIG. 3*c*. The second shaping head 42*i* is arranged to be in a fixed rotational position when brought into contact with a body of filter material to form a recess. The third shaping head 42*ii*, illustrated in FIGS. 6*c* and 6*c*', comprises a hexagonal based pyramidal frustum shape, and can be used to form the third filter unit 20*ii* of FIG. 3*d*. The third shaping head 42*ii* is arranged to be in a fixed rotational position when brought into contact with a body of filter material to form a recess.

The fourth and fifth shaping heads 42*iii*, 42*iv*, illustrated in FIGS. 6*d*, 6*d*', 6*e*, 6*e*', are substantially cone shaped, and correspond to the shape of and can be used to form the recess 27*iii* described with reference to FIGS. 3*e* and 3*e*'. The fourth shaping head 42*iii* has a narrower second cone at the end of the shaping head 42*iii* having a steeper slant angle than the fifth shaping head 42*iv*. The fourth and fifth shaping heads 42*iii*, 42*iv* each have reflective symmetry about any line which is perpendicular to their longitudinal axis and infinite rotational symmetry about the longitudinal axis. The fourth and fifth shaping heads 42*iii*, 42*iv* are arranged to be spinning when brought into contact with a body of filter material to form a recess or non-uniformity in the internal diameter of a tube.

The sixth and seventh shaping heads 42*v*, 42*vi*, illustrated in FIGS. 6*f*, 6*f*, 6*g* and 6*g*' corresponds to the shape of and can be used to form the recess 27*iv* described with reference to FIGS. 3*f* and 3*f*. The second portion in the form of a cylinder of the sixth shaping head 42*v* is shorter than the corresponding portion of the seventh shaping head 42*vi*, meaning that the seventh shaping head 42*vi* can extend further into filter material than the sixth shaping head. The seventh shaping head 42*vi* can, for instance, be arranged to extend between 5 mm and 15 mm, between 6 mm and 10 mm or about 8 mm into a filter unit, whereas the sixth shaping head 42*v* can be arranged to extend between 3 mm and 8 mm, between 3 mm and 6 mm, or about 5 mm into a filter unit. The sixth and seventh shaping heads 42*v*, 42*vi* each have reflective symmetry about any line which is perpendicular to their longitudinal axis and infinite rotational symmetry about the longitudinal axis. The sixth and seventh shaping heads 42*v*, 42*vi* are arranged to be spinning when brought into contact with a body of filter material to form a recess or non-uniformity in the internal diameter of a tube.

The eighth shaping head 42*vii*, illustrated in FIGS. 6*h* and 6*h*' has a shape corresponding to a round-headed cylinder. The eighth shaping head 42*vii* has reflective symmetry about any line which is perpendicular to its longitudinal axis and infinite rotational symmetry about the longitudinal axis. The eighth shaping head 42*vii* is arranged to be spinning when brought into contact with a body of filter material to form a recess or non-uniformity in the internal diameter of a tube.

The ninth shaping head 42*viii*, illustrated in FIGS. 6*i* and 6*i*', corresponds to the shape of and can be used to form the recess 27*v* described with reference to FIGS. 3*g* and 3*g*'. The ninth shaping head 42*viii* has reflective symmetry about any line which is perpendicular to its longitudinal axis and infinite rotational symmetry about the longitudinal axis. The ninth shaping head 42*viii* is arranged to be spinning when brought into contact with a body of filter material to form a recess or non-uniformity in the internal diameter of a tube.

The tenth, eleventh and twelfth shaping heads 42*ix*, 42*x*, 42*xi*, illustrated in FIGS. 6*j*, 6*j*', 6*k*, 6*k*', 61, 61' each have a cone shape. The slant angle of the cone in each case can be between 20° and 40° from the longitudinal axis of the cone. The tenth shaping head 42*ix* has a cone shape extending from a cylindrical portion of the shaping head, such that a recess shape formed by this shaping head will have a cylindrical shape leading to a cone shape as the depth increases. The eleventh shaping head 42*x* has a cone shape which can be used to form a recess the full depth of which is shaped as a cone. The twelfth shaping head 42*xi* has a cone shape at its end arranged to face the tobacco industry product, followed by a cylindrical portion and then a frustum cone shape. The slant angle of the frustum cone can be between 40° and 60° from the longitudinal axis of the cone, in the present example about 50°. The tenth, eleventh and twelfth shaping heads 42*ix*, 42*x*, 42*xi* have reflective symmetry about any line which is perpendicular to their longitudinal axis and infinite rotational symmetry about the longitudinal axis and are arranged to be spinning when brought into contact with a body of filter material to form a recess or non-uniformity in the internal diameter of a tube.

The thirteenth shaping head 42*xii*, illustrated in FIGS. 6*m* and 6*m*', corresponds to the shape of and can be used to form the recess 27*vi* described with reference to FIGS. 3*h* and 3*h*'. The thirteenth shaping head 42*xii* has no lines of reflective symmetry and order 2 rotational symmetry about the longitudinal axis of the shaping head 42*xii*. The thirteenth shaping head 42*xii* is arranged to be in a fixed rotational position when brought into contact with a body of filter material to form a recess.

The fourteenth shaping head 42*xiii*, illustrated in FIGS. 6*n* and 6*n*', corresponds to the shape of and can be used to form the recess 27*vii* described with reference to FIGS. 3*i* and 3*i*'. The fourteenth shaping head 42*xiii* has no lines of reflective symmetry and order 1 rotational symmetry about the longitudinal axis of the shaping head 42*xiii*. The fourteenth shaping head 42*xiii* is arranged to be in a fixed rotational position when brought into contact with a body of filter material to form a recess.

The fifteenth shaping head 42*xiv*, illustrated in FIGS. 60 and 60', corresponds to the shape of and can be used to form the recess 27*viii* described with reference to FIGS. 3*j* and 3*j*'. The fifteenth shaping head 42*xiv* has no lines of reflective symmetry and order 1 rotational symmetry about the longitudinal axis of the shaping head 42*xiv*. The fifteenth shaping head 42*xiv* is arranged to be in a fixed rotational position when brought into contact with a body of filter material to form a recess.

The apparatus 40 may be configured so that, in use, the longitudinal axis of the shaping head 42 and the longitudinal axis of the tobacco industry product 41 are aligned. In such an arrangement, the shaping head 42 and the tobacco industry product 41 may be said to have a common longitudinal axis.

Referring again to the first apparatus 40 of FIGS. 5*a* to 5*e*, in the present example, the apparatus 40 comprises a drum 43 arranged to move the tobacco industry product 41 relative to the shaping head 42 in order to bring the shaping head 42 into contact with an end of the tobacco industry product 41.

The drum 43, in the present example, is provided as a modification to the known separator drum used in cigarette manufacture to separate first and second tobacco rods so that a filter can be placed between the tobacco rods and the rods and filter can then be wrapped in tipping paper. The drum 43 is modified to include a head support unit 44 which supports a plurality of shaping heads 42 arranged such that they are spaced circumferentially around the drum 43. The longitudinal axis of each of the shaping heads 42 is parallel to the axis of rotation of the drum 43. The drum 43 includes a plurality of moving plates 45 in each of which first and second product receiving units or regions 46 are provided, in the form of flutes 46 in the present example. Each flute 46 is arranged to receive a tobacco industry product 41 and is generally shaped as an elongate groove formed in the plate 45 within which the tobacco industry product 41 can sit. The tobacco industry products 41 are held within the flutes 46 by suction through apertures formed in the base of the flutes 46, as known in conventional separator and similar drums.

In the present example, the moving plates 45 move in a reciprocating manner towards and away from the shaping heads 42 held by the head support member 44 in order to bring tobacco industry products 41 into contact with the shaping heads 42. In an alternative exemplary arrangement, the apparatus 40 may be configured so that both the plates 45 and the head support unit 44 are arranged to move in use, or so that only the head support unit 44 moves, in order to bring the shaping heads 42 into contact with the end of the tobacco industry product 41. In order to provide additional force along the longitudinal axis of each tobacco industry product 41 when held in the flutes 46, pushing members 50 are provided. These, in the present example, comprise silicon caps 50*a* on the end of rods sob. The caps 50*a* receive a portion of the second end 41*b* of each tobacco industry product 41. A barrel cam arrangement 49 is used to move the pushing members 50 in a reciprocating manner corresponding to the movement of the plates 45, to move the tobacco industry products 41 longitudinally towards and away from the shaping heads 42. Alternatively, the pushing members 50 can be fixed rather than moving or a swash-plate type arrangement can be used to push tobacco industry products 41 longitudinally from the end opposite to the end which is to be shaped. The contact time between a given shaping head 42 and a tobacco industry product can be between 50 ms and is, for instance between 100 ms and 300 ms, or between 150 ms and 200 ms.

The apparatus 41 may further comprise a heating element 47 which is arranged to heat the shaping heads 42. The heating element extends around about 120° of the outer periphery of the drum 43. When the shaping heads 42 are heated shortly before or during contact with the end of the tobacco industry product 41, the heat may deform the material of the tobacco industry product 41, which aids in changing the shape of the end of the tobacco industry product 41. The heating element 47 may be an induction coil. Alternatively, the shaping head 42 may be heated by a hot air system or a direct thermocouple. The shaping heads 42 can be heated to between 270° C. and 320° C., with a preferred temperature of 295° C. For inductive heating, the shaping heads 42 can be arranged to have a magnetic permeability in the range of $1.26\times10^{-4}$ H/m (e.g. nickel) to $2.26\times10^{-3}$ (e.g. stainless steel) H/m and/or a relative permeability of 100-1800. The electrical resistance of the shaping heads 42 can be in the range of $6.85\times10^{-8}$ Ωm (e.g. nickel) to $15\times10^{-8}$ Ωm (e.g. steel).

As shown in FIG. 5*d*, a gearing mechanism 48 can be used to rotate the shaping heads 42, in the form of mandrels in the present example. Each mandrel 42 extends into a base shaft 42*a* which extends into and is supported by the head support unit 44. In particular, the head support unit 44 includes first and second bearings 44*a*, 44*b* which support the base shaft 42*a* of each mandrel 42, allowing it to rotate. Each mandrel base shaft 42*a* is also connected to and arranged to be turned via a mandrel driving cog 48*a* which in turn meshes with a fixed cog 48*b* extending around the periphery of the drum 43 and fixed in relation to the head support unit 44. As the outer portions of the drum 43 rotate, including the head support unit 44, this causes the mandrel driving cog 48*a* for each mandrel 42 to rotate as its teeth mesh with the fixed cog 48*b*, and this rotates the mandrel 42. The ratio of the turning speed of the mandrels 42 to the drum 43 can be between 2:1 and 12:1, for instance between 5:1 and 10:1, and in one example 10:1. Other arrangements for turning the shaping heads 42 can also be used, such as a separate motor arrangement for rotating one or more of the heads 42. The mandrel driving cogs 48*a* can be removed from the mandrel base shafts 42*a* of the mandrels 42 in order to provide fixed rather than rotating mandrels 42.

In an alternative exemplary arrangement, the apparatus 40 may further comprise a second shaping head (not shown) which is substantially the same as the shaping head 42 described above, and is arranged to change the shape of a second end of the tobacco industry product 41. In this arrangement, the apparatus 40 can shape both ends of the tobacco industry product, either simultaneously or in sequence.

FIGS. 5*f* and 5*g* are perspective views of a second apparatus 52 for shaping a tobacco industry product. The second apparatus 52 is identical to the first apparatus 40, except that an extended heating element 57 is provided in place of the heating element 47 of the first apparatus 40. The extended heating element 57 extends about 270° around the outer periphery of the drum 43 of the second apparatus 52, which is otherwise the same as that of the first apparatus 40. In alternative arrangements, the extended heating element can extend between about 180° and about 300°, or between about 240° and about 280° around the periphery of the drum 43. The heating element extending 270° around the drum means that the mandrels 42 can be heated for over half of the time that they are being rotated around the drum 43, enabling them to reach higher temperatures. The mandrels 42 are also heated during most or all of the time period in which each mandrel contacts a tobacco industry product 41, as illustrated in FIG. 5*g*.

Figure 5H:
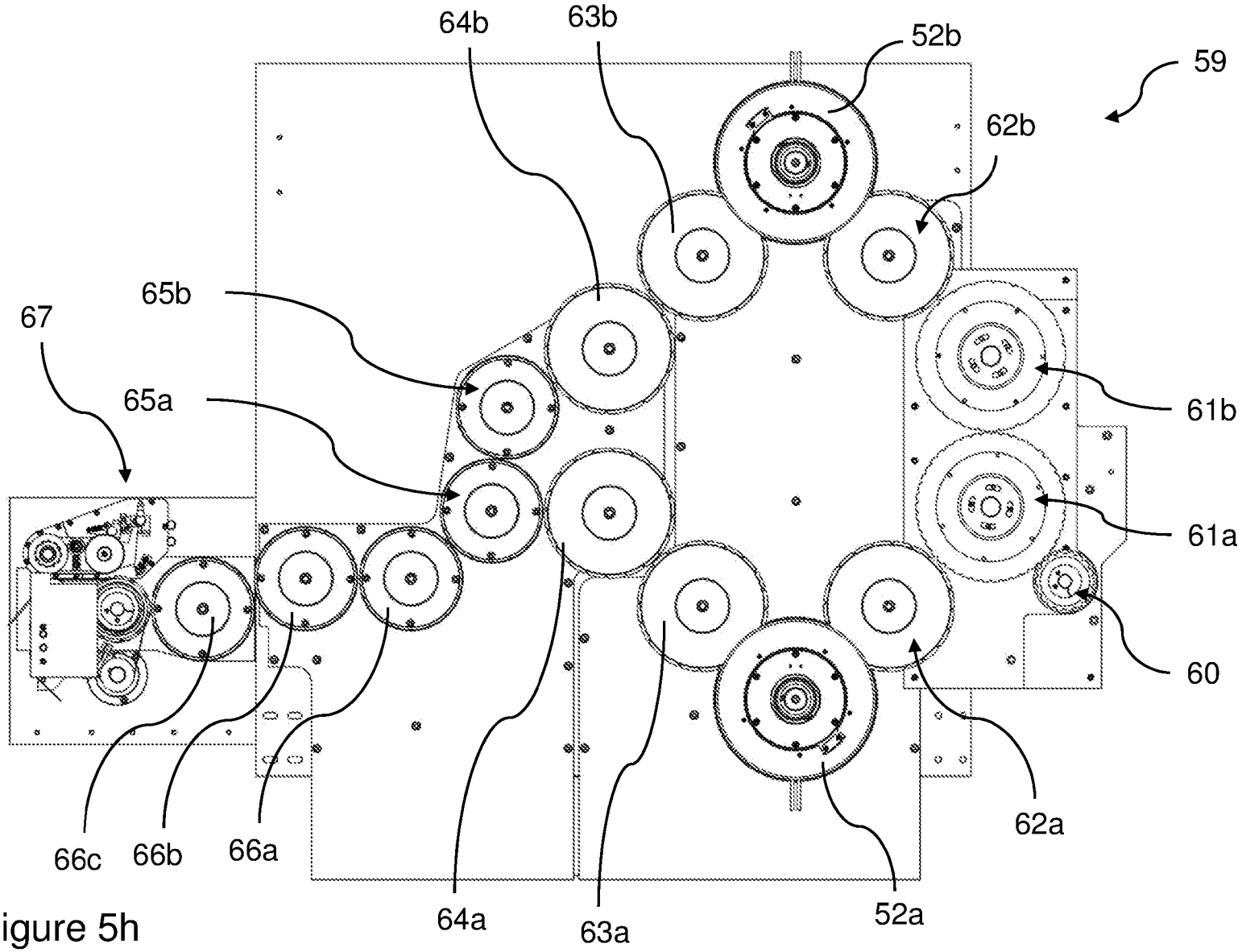
FIG. 5*h* is a side-on view of a machine including two of the second shaping apparatus of FIGS. 5*f* and 5*g* arranged to operate in parallel.

FIG. 5*h* is a side-on view of a machine 59 including two of the second apparatus 52 (indicated respectively as sea, 52*b*) of FIGS. 5*f* and 5*g* arranged to operate in parallel. As explained in more detail below, a sequence of drums is provided for transferring tobacco industry products onto the two shaping apparatus sea, 52*b* from an existing cigarette making machine or from a hopper containing such products. Tobacco industry products, for instance cigarettes, are received at the feed drum 60, which in the present example rotates clockwise when viewed from the side illustrated in FIG. 5*h*, and passed to first and second dividing drums 61*a*, 61*b*. First dividing drum 61*a* received the products from the feed drum and has flutes 61*a*' spaced at twice the pitch of the flutes 61*b*' of the second dividing drum 61*b*, and every other tobacco industry product is transferred from the first dividing drum 61*a* onto the second dividing drum 61*b*, so that both drums 61*a*, 61*b* pass on the same number of tobacco industry products at the same speed to the next drums in the sequence.

After the respective first and second dividing drums 61*a*, 61*b*, products are passed to respective first and second transfer drums 62*a*, 62*b*, which respectively transfer tobacco industry products onto respective first and second installations of the second shaping apparatus sea, 52*b* as described with reference to FIGS. 5*f* and 5*g*. First and second inspection drums 63*a*, 63*b* receive tobacco industry products from the respective first and second shaping apparatus sea, 52*b* and can have an arrangement of one or more cameras (not shown) to inspect tobacco industry products for any deformities in the shape formed by the second shaping apparatus sea, 52*b* or any other deformities or abnormalities which may be present. From the inspection drums 63*a*, 63*b* products are passed to first and second rejection drums 64*a*, 64*b* where any defective products can be removed from the flow of products. First and second recombining drums 65*a*, 65*b* receive products from the respective first and second rejection drums 64*a*, 64*b* and pass them onto a sequence of first, second and third output drums 66*a*, 66*b*, 66*c*. These pass products on to an output conveyor belt system 67, from which the products can be fed directly to a packaging machine or to a further hopper.

Having first and second installations of the shaping apparatus 52*a*, 52*b* operating in parallel enables the throughput of the machinery to be doubled as compared to a single installation operating at the same speed. Alternatively or in addition, installations of the second shaping apparatus 52*a*, 52*b* can be configured to operate in a series arrangement, for instance applying different shapes to the first end of a tobacco industry product via each respective shaping apparatus 52*a*, 52*b*. For instance, a first installation of the apparatus 52*a* could form a recess with a 5 mm depth and a second installation of the apparatus 52*b* could extend the recess to a depth of 8 mm.

Figure 7:
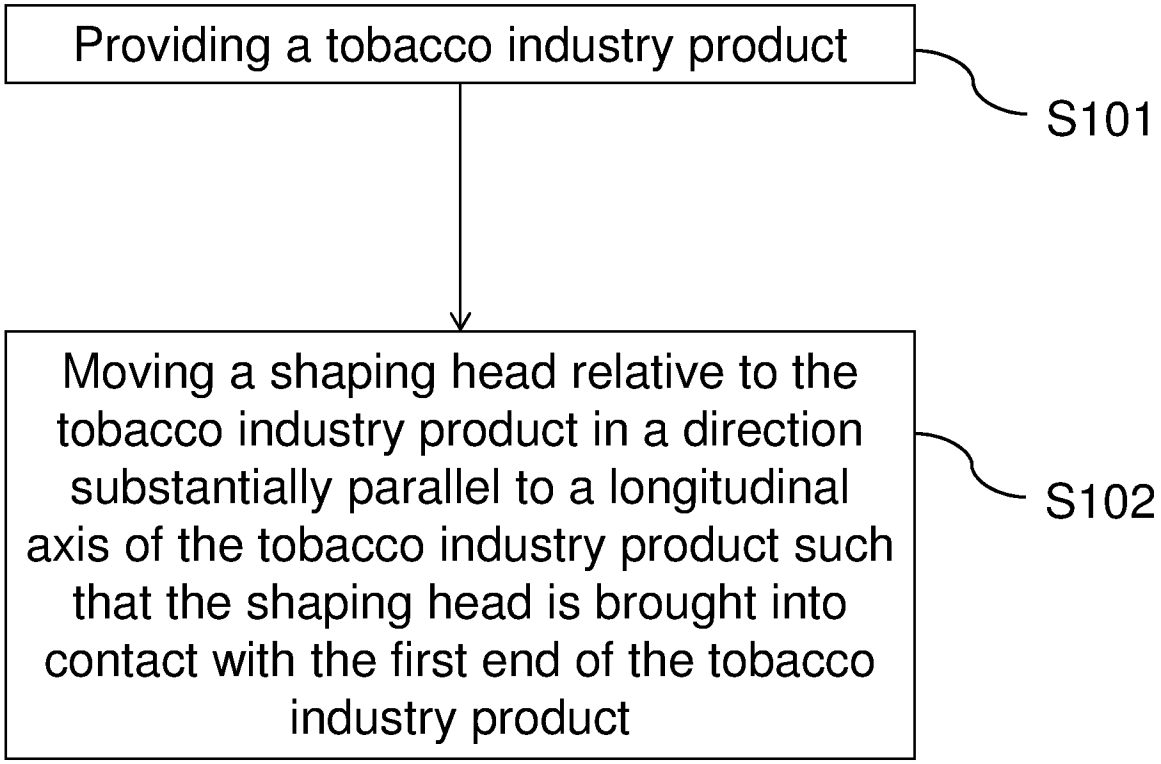
FIG. 7 is a flow diagram illustrating a method of shaping a tobacco industry product.

Also presented herein is a method of shaping a tobacco industry product. The method is shown in FIG. 7 and comprises the steps of: providing a tobacco industry product (S101); and changing the shape of a first end of the tobacco industry product by moving a shaping head and/or the tobacco industry product in a direction substantially parallel to a longitudinal axis of the tobacco industry product such that the shaping head is brought into contact with the first end of the tobacco industry product (S102).

Figure 8:
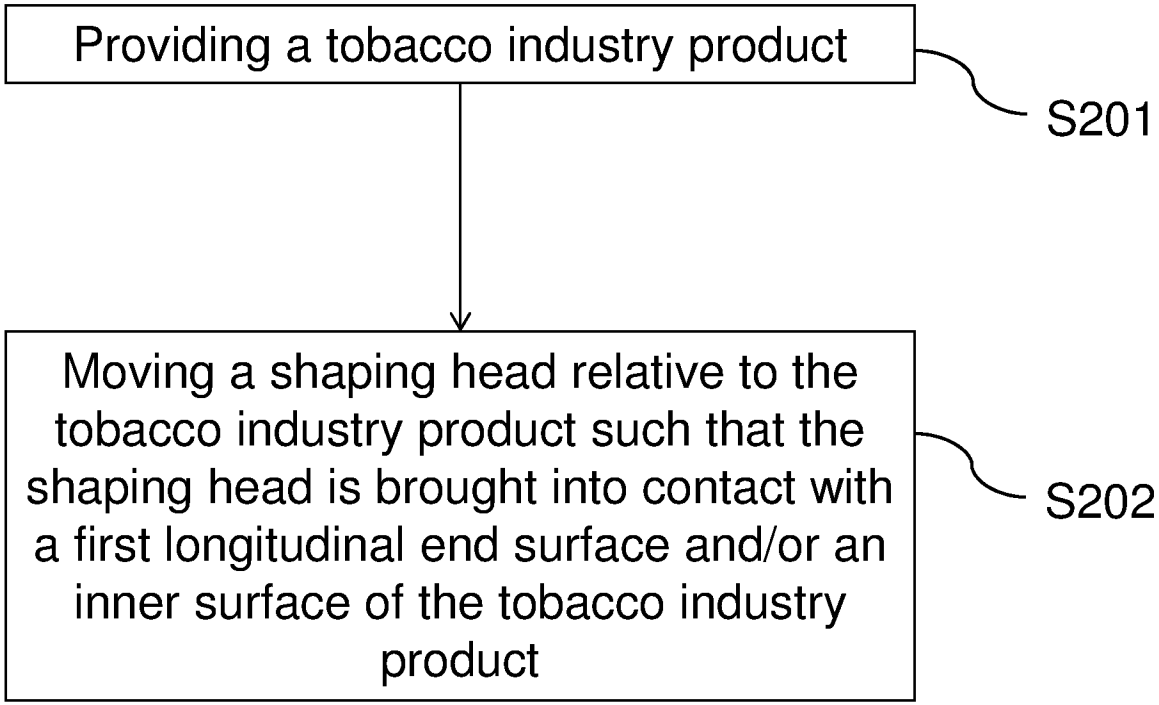
FIG. 8 is a flow diagram illustrating a method of shaping a tobacco industry product.

Also presented herein is a further method of shaping a tobacco industry product. The method is shown in FIG. 8 and comprises the steps of: providing the tobacco industry product (S201); and changing the shape of a first end of the tobacco industry product by moving a shaping head and/or the tobacco industry product such that the shaping head is brought into contact with a first longitudinal end surface and/or an inner surface of the tobacco industry product (S202).

In order to address various issues and advance the art, the entirety of this disclosure shows by way of illustration various embodiments in which the claimed invention(s) may be practiced and provide for superior smoking articles and filter units therefor. The advantages and features of the disclosure are of a representative sample of embodiments only, and are not exhaustive and/or exclusive. They are presented only to assist in understanding and teach the claimed features. It is to be understood that advantages, embodiments, examples, functions, features, structures, and/or other aspects of the disclosure are not to be considered limitations on the disclosure as defined by the claims or limitations on equivalents to the claims, and that other embodiments may be utilised and modifications may be made without departing from the scope and/or spirit of the disclosure. Various embodiments may suitably comprise, consist of, or consist essentially of, various combinations of the disclosed elements, components, features, parts, steps, means, etc. In addition, the disclosure includes other inventions not presently claimed, but which may be claimed in future.

The invention claimed is:

1. A method of shaping a tobacco industry product, the method comprising:

providing the tobacco industry product; and changing a shape of a first end of the tobacco industry product by moving a shaping head and/or the tobacco industry product such that the shaping head is brought into contact with the first end of the tobacco industry product, and rotating the shaping head about a longitudinal axis of the shaping head while changing the shape of the first end of the tobacco industry product, wherein the first end of the tobacco industry product comprises filter material and wherein the shaping head performs at least one of:

forming a chamfer in the filter material of the first end of the tobacco industry product; and forming a recess in the filter material of the first end of the tobacco industry product by indentation.

2. A method of shaping a tobacco industry product according to claim 1, wherein the shaping head is brought into contact with an end surface of the first end of the tobacco industry product and/or an inner surface of the tobacco industry product.

3. A method of shaping a tobacco industry product according to claim 1, wherein moving the shaping head and/or the tobacco industry product comprises moving the shaping head and/or tobacco industry product in a reciprocating manner.

4. A method of shaping a tobacco industry product according to claim 1, wherein the providing of the tobacco industry product comprises inserting the tobacco industry product into a receiving unit and gripping the tobacco industry product in the receiving unit.

5. A method of shaping a tobacco industry product according to claim 1, comprising changing a shape of a first end of each of a plurality of tobacco industry product simultaneously using a plurality of shaping heads.

6. A method of shaping a tobacco industry product according to claim 5, wherein said shaping heads are provided on first and second drums arranged in a series or in a parallel configuration.

7. A method of shaping a tobacco industry product according to claim 1, comprising heating the shaping head.

8. A method of shaping a tobacco industry product according to claim 1, wherein the shaping head and/or the tobacco industry product is moved in a direction substantially parallel to a longitudinal axis of the tobacco industry product such that the shaping head is brought into contact with the first end of the tobacco industry product.

* * * * *